US005195350A

United States Patent [19]

Aikens et al.

[11] Patent Number: 5,195,350

[45] Date of Patent: Mar. 23, 1993

[54] METHOD FOR FORMING FEATURES ON AN ELONGATED METAL WIRE

[75] Inventors: Paul W. Aikens, Etters; David F. Fusselman, Middletown, both of Pa.; James D. Strong, Bear, Del.

[73] Assignee: E. I. Du Pont de Nemours and Company, Wilmington, Del.

[21] Appl. No.: 817,630

[22] Filed: Jan. 7, 1992

Related U.S. Application Data

[62] Division of Ser. No. 694,513, Apr. 25, 1991, Pat. No. 5,117,671.

[51] Int. Cl.[5] ..... B21G 3/16

[52] U.S. Cl. ..... 72/402; 72/403; 29/874

[58] Field of Search ..... 72/402, 403, 450, 451; 29/874, 882, 747

[56] References Cited

U.S. PATENT DOCUMENTS

| | | | |
|---|---|---|---|
| 124,619 | 3/1872 | Pedder . | |
| 391,825 | 10/1888 | Taylor | 72/402 |
| 434,139 | 8/1890 | Taft | 72/402 |
| 684,216 | 10/1901 | Gardner | 72/402 |
| 1,322,584 | 11/1919 | Kraft | 72/450 |
| 2,106,274 | 1/1938 | Frayer | 72/402 |
| 2,467,012 | 4/1949 | Deuschle | 72/402 |
| 3,695,310 | 10/1972 | Donadio | 72/402 |
| 3,938,364 | 2/1976 | Ragard | 72/402 |
| 4,041,766 | 8/1977 | Johnson | 72/402 |
| 4,274,699 | 6/1981 | Keim | 339/176 |
| 4,836,006 | 6/1989 | Brown | 72/338 |

FOREIGN PATENT DOCUMENTS

| | | | |
|---|---|---|---|
| 446217 | 1/1948 | Canada | 29/882 |
| 425573 | 2/1926 | Fed. Rep. of Germany | 72/403 |
| 2930560 | 1/1981 | Fed. Rep. of Germany | 29/874 |
| 2951587 | 7/1981 | Fed. Rep. of Germany | 72/451 |
| 2-239580 | 9/1990 | Japan . | |
| 19818 | 11/1892 | United Kingdom | 72/403 |
| 11929 | 11/1914 | United Kingdom | 72/402 |
| 681986 | 11/1952 | United Kingdom | 72/403 |
| 920157 | 3/1963 | United Kingdom | 72/402 |

OTHER PUBLICATIONS

Lebo, Leith W., "Swaging Instead of Stamping for Contact Pins", from *Connection Technology*, Apr. 1989, pp. 25 & 26.

*Primary Examiner*—Daniel C. Crane
*Attorney, Agent, or Firm*—John E. Griffiths

[57] ABSTRACT

The present invention relates to methods and apparatus for forming features on an elongated metal wire and, in particular to making features, such as pin tips, compliant sections and retention sections on electrical terminal pins for use in interconnecting electrical leads, plated through holes in printed circuit boards and/or connector contacts.

14 Claims, 21 Drawing Sheets

METHOD FOR FORMING FEATURES ON AN ELONGATED METAL WIRE

This is a division of application Ser. No. 07/694,513, filed Apr. 25, 1991, now U.S. Pat. No. 5,117,671, issued Jun. 2, 1992.

BACKGROUND OF THE INVENTION

1. Field of the Invention

This invention relates to methods and apparatus for forming features on an elongated metal wire and, in particular, to making features, such as pin tips, compliant sections and retention sections, on electrical terminal pins for use in interconnecting electrical leads, plated through holes in printed circuit boards and/or connector contacts.

2. Description of Related Art

It is well known in the connector art to use electrical pins to interconnect electrical leads, plated through holes in printed circuit boards and/or connector contacts. Such pins typically have square or round cross sections perpendicular to their longitudinal axes.

The pins are made from an electrically conductive material, such as copper, brass, phosphor bronze, beryllium copper or the like. It is further known to plate or coat the pins with a conductive layer, such as tin, nickel, palladium, gold, silver or a suitable alloy. Pins are plated in order to apply a layer on a pin core that does not oxidize as much as the material of the core. Less oxidation at an electrical connection improves electrical performance. Pins are made with a core material different than the plating material in order to reduce the cost of the pin and/or to make the pin more rigid than if the pin was entirely made out of the plating material.

It is well known in the art to make pin tips with flat tapered sides to facilitate alignment with and/or insertion into a plated through hole or a mating contact. For instance, FIG. 1 shows an enlarged perspective view of an electrical terminal pin tip 2 of a prior art electrical terminal pin 4 with a portion broken away to show a cross section 6 of the pin 4. The pin 4 comprises an electrically conductive inner core 8 plated with an electrically conductive outer layer 10. FIG. 2 is an end view of the prior art electrical pin tip 2 of FIG. 1.

Referring to FIGS. 1 and 2, the pin tip 2 has a pair of opposed flat swaged plated sides 12 that taper or slope towards a longitudinal axis of the pin 4 as the pin 4 approaches its longitudinal end. The pin tip 2 further has a pair of opposed flat trimmed non-plated sides 14 that taper or slope towards the longitudinal axis of the pin 4 as the pin 4 approaches its longitudinal end. The opposed flat trimmed non-plated sides 14 are jointed at the longitudinal end by a trimmed non-plated curved or cylindrical surface 16. When this tip 2 is inserted into a plated through hole or a female contact, the plated through hole or the female contact can slide against the non-plated tapered sides 14 causing some of the core material to be transferred onto the plated through hole or the female contact. Multiple insertions and withdrawals of the pin 4 into plated through holes or mating female contacts increase the probability of rubbing some of the core material off the non-plated sides 14 onto the plated through holes or mating female contacts. This transferred core material can ultimately be dragged or positioned between the pin plating 10 and the plated through hole or the female contact. Depending on the materials used for the core 8 and the plating or layer 10, this may increase the oxidation rate of the connection between the pin 4 and the plated through hole or the female contact, compared to a connection directly between pin plating 10 and the plated through hole or the female contact.

Other pin tips are shaped by trimming which removes plating material from trimmed sides. Then one or more additional process step is performed to plate the trimmed sides. Although this ensures that all exterior sides and surfaces of the pin tip are plated, it adds time and cost to the manufacturing process.

It is typical to simultaneously insert a plurality of pins, such as, mounted in a connector housing, into a mating set of plated through holes or female terminals. The insertion force required increases with the number of pins being inserted and can be significant. Tapered flat sides on pin tips reduce the insertion force required. However, it is desirable to further reduce the longitudinal insertion force without reducing the lateral retention force applied on the pin by the plated through holes or female terminals.

It is desirable to provide pin tips and methods and apparatus for making textures, such as pin tips, on electrical terminal pins that satisfy the above described needs and overcomes the above described disadvantages of the prior art.

SUMMARY OF THE INVENTION

The present invention is directed to an apparatus for forming a feature on an elongated metal wire, the apparatus comprises a tool guide, a first forming tool, a second forming tool, a ring, a first link, and a second link. The tool guide has a first surface, a second surface and a passage. The first surface is cylindrical about an axis. The second surface is connected to one end of the cylindrical surface. The second surface has a first slot recessed in the second surface and the first slot passes through the axis. The passage extends through the tool guide along the axis. The first forming tool has a first projection and a first working end for contacting the wire and conforming the contacted wire to the shape of the first working end. The first tool is pivotally in the first slot with the first working end facing the axis. The second forming tool has a second projection and a second working end for contacting the wire and conforming the contacted wire to the shape of the second working end. The second tool is pivotally in the first slot with the second working end facing the axis. The ring has at least two projections and an inner cylindrical surface for contacting the tool guide cylindrical surface. The ring is capable of oscillating around the axis with respect to the tool guide. The first link has a first end and a second end. The first end is pivotally connected to the first tool projection and the second end pivotally is connected to a first one of a set of the ring projections. The second link has a first end and a second end. The first end is pivotally connected to the second tool projection and the second end is pivotally connected to a second one of the set of the ring projections. When the wire is positioned in the passage and extends out of the slot and the ring is oscillated in a first direction with respect to the tool guide, the first and second forming tools are forced by the links to slide in the first slot towards the axis into contact with the wire. When the ring is oscillated in a second direction with respect to the tool guide, the first and second forming tools are forced by the links to slide in the first slot away from the axis.

The present invention is further directed to a method for forming a feature on an elongated metal wire. The method comprises: simultaneously stamping a first pair of distal sides of the wire between a working end of a first forming tool and a working end of a second forming tool such that the working ends press into the first pair of the distal sides a first distance; simultaneously stamping a second pair of distal sides of the wire between a working end of a third forming tool and a working end of a fourth forming tool such that the working ends press into the second pair of the distal sides a second distance; simultaneously stamping the first pair of the distal sides of the wire between the working end of the first forming tool and the working end of the second forming tool such that the working ends press into the first pair of the distal sides a third distance; simultaneously stamping the second pair of distal sides of the wire between the working end of the third forming tool and the working end of the fourth forming tool such that the working ends press into the second pair of the distal sides a fourth distance, whereby the feature is formed in the sides of the metal wire.

BRIEF DESCRIPTION OF THE DRAWINGS

The invention can be more fully understood from the following detailed description thereof in connection with accompanying drawings described as follows.

DESCRIPTION OF THE PREFERRED EMBODIMENT(S)

Figure 2:
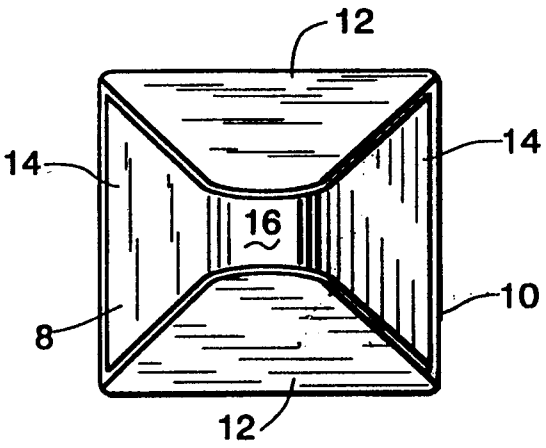
Fig. 2 PRIOR ART
FIG. 2 is an end view of the prior art electrical pin tip of FIG. 1.

Throughout the following detailed description, similar reference characters refer to similar elements in all figures of the drawings.

Figure 5:
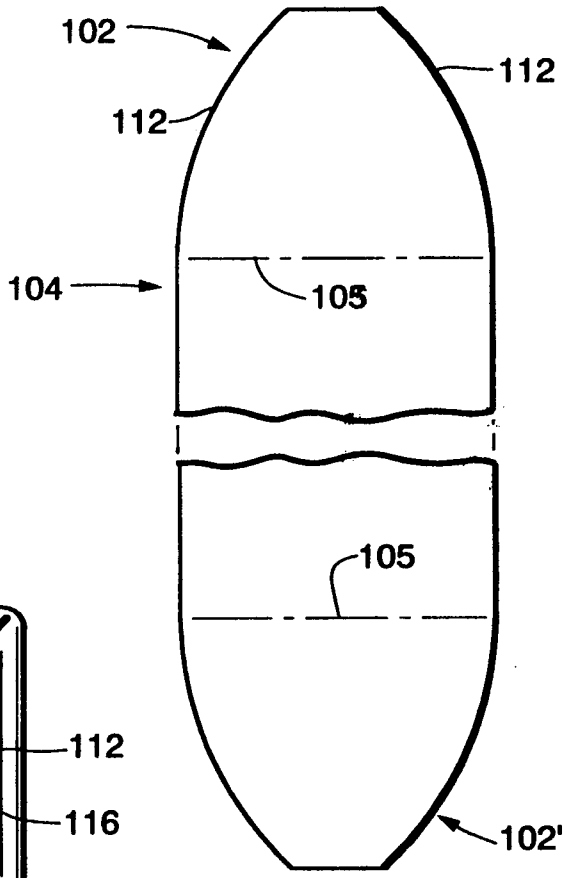
FIG. 5 is a side view of the electrical terminal pin having a pair of the electrical pin tips of FIGS. 3 and 4.
Figure 4:
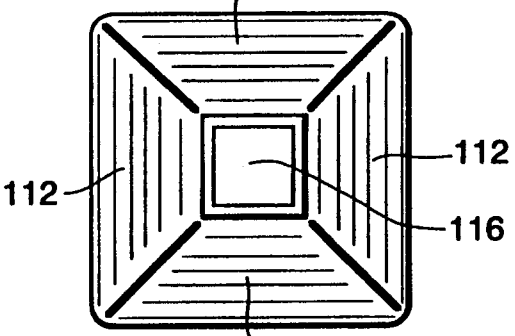
FIG. 4 is a end view of the electrical terminal pin tip of FIG. 3.
Figure 3:
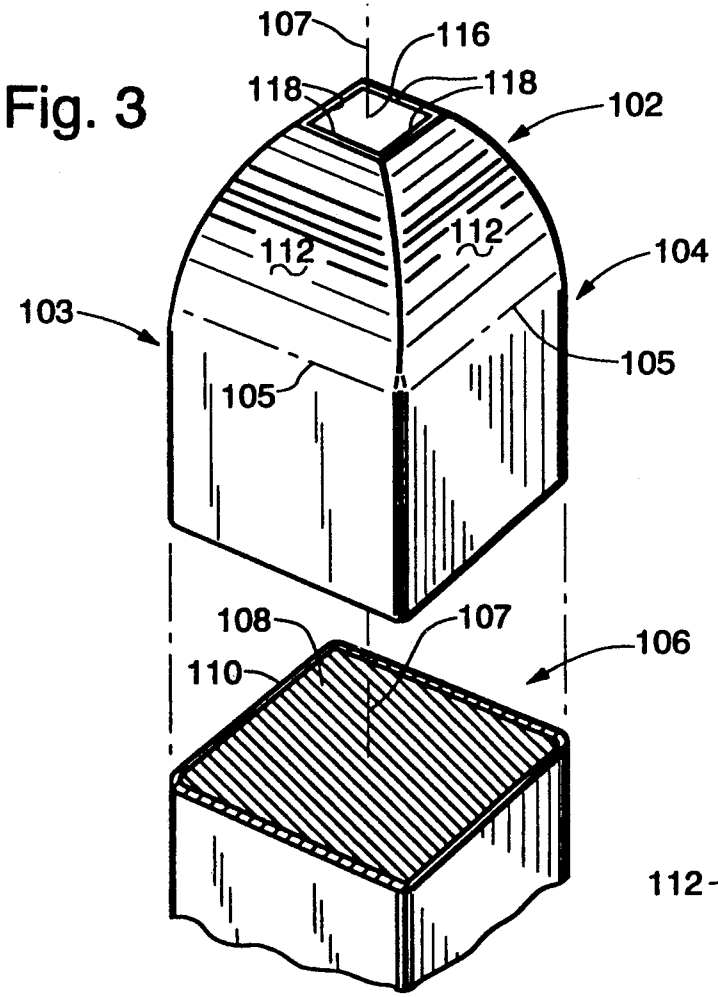
FIG. 3 is an enlarged perspective view of a first embodiment of an electrical terminal pin tip on an end portion of an electrical terminal pin with a portion broken away to show a cross section of the pin in accordance with the present invention.

Referring to FIG. 3, there is illustrated an enlarged perspective view of a first embodiment of an electrical terminal pin tip 102 in accordance with the present invention. The pin tip 102 is on an end portion 103 of an electrical terminal pin 104 with a portion broken away to show a cross section 106 of the pin 104. The electrical terminal pin 104 is for inserting tip first into and electrically connecting to an electrical female terminal or a plated-through hole of a printed circuit board. FIG. 4 is a end view of the electrical terminal pin tip 102 of FIG. 3. FIG. 5 is a side view of the electrical terminal pin 104 having a pair of the electrical pin tips 102,102' of FIGS. 3 and 4.

Referring to FIGS. 3–5, the electrical terminal pin 104 comprises an electrically conductive core 108 and a conductive layer 110. The conductive layer 110 is plated on a perimeter of the core 108 at least near or immediately adjacent an end of the pin 104. The pin 104, the core 108 and the plating or layer 110 are symmetric about a longitudinal axis 107 of symmetry.

The pin tip 102 comprises a non-plated substantially flat end 116 of the core 108 and at least one curved side 112 substantially plated with the conductive layer 110. Preferably, the non-plated substantially flat end 116 is substantially perpendicular to the axis 107 of symmetry. Further, the non-plated substantially flat end 116 has at least one edge 118. In the embodiment illustrated in FIGS. 3-5, the non-plated substantially flat end 116 is substantially square with four edges 118. Since there is one curved side 112 corresponding to each edge 118, there are four curved sides 112. Each one of the curved sides 112 extends from a corresponding one of the substantially flat end edges 118 away from the longitudinal axis 107 to a circumference 105 of the pin 104 near or immediately adjacent the pin tip 102. Preferably, the curved sides 112 are shaped substantially alike. The conductive layer 110 entirely covers each one of the curved sides 112 at least from the pin perimeter 105 to half way along the side 112 to the non-plated flat end 116. Preferably, each one of the curved sides 112 is a convex portion of a corresponding cylinder. It is also preferred that the plated curved sides 112 intersect the pin perimeter 105 at an angle tangent to the corresponding cylinder.

The pin 104 may further comprise a second pin tip 102' on another end of the pin 104 distal to the first tip 102. The second tip 102' can be a mirror image of the first tip 102. In other words, the second tip 102' can have the same shape as the first tip 102 but it can be rotated 180 degrees. Alternatively, the second pin tip 102' can be configured like any other tip described herein or elsewhere.

Figure 8:
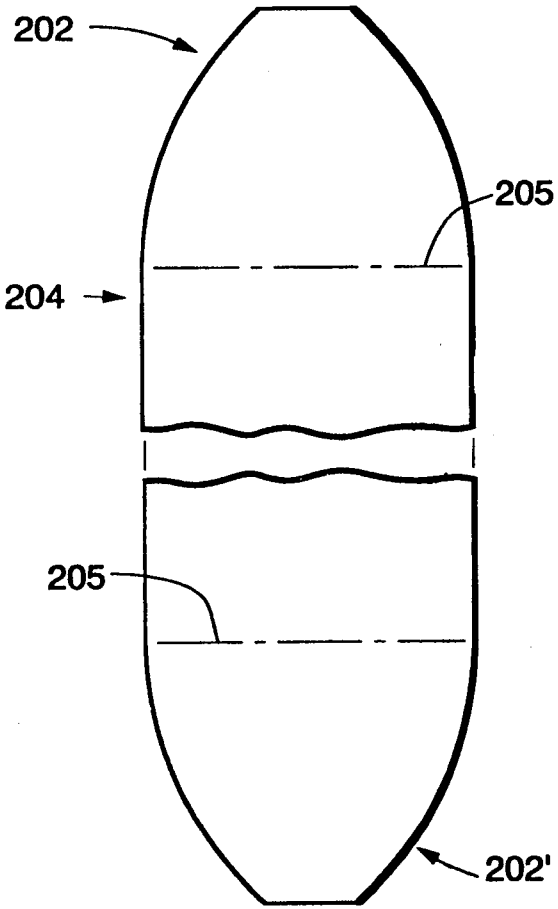
FIG. 8 is a side view of an electrical terminal pin having a pair of the electrical pin tips of FIGS. 6 and 7.
Figure 7:
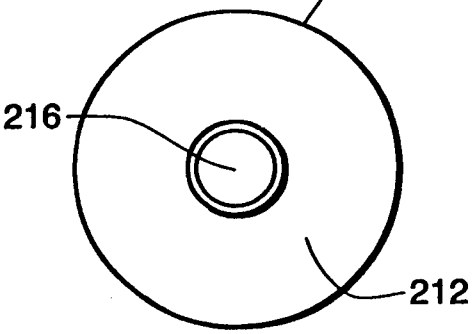
FIG. 7 is an end view of the electrical terminal pin tip of FIG. 6.
Figure 6:
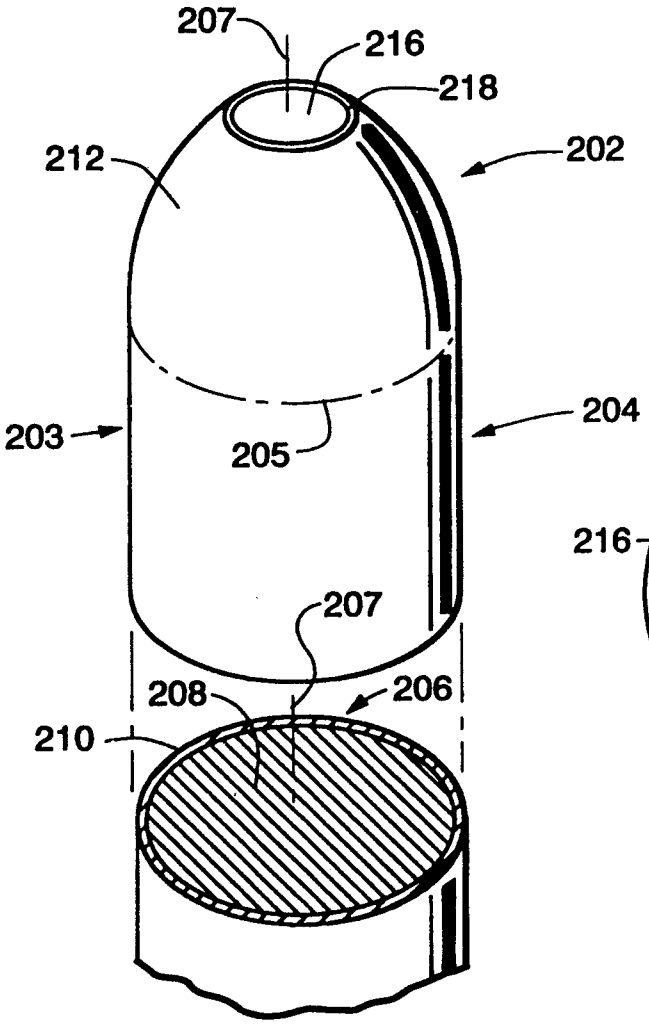
FIG. 6 is an enlarged perspective view of a second embodiment of an electrical terminal pin tip on an end portion of an electrical terminal pin with a portion broken away to show a cross section of the pin in accordance with the present invention.

FIG. 6 is an enlarged perspective view of a second embodiment of an electrical terminal pin tip 202 on an end portion 203 of an electrical terminal pin 204 with a portion broken away to show a circular cross section 206 of the pin 204 in accordance with the present invention. FIG. 7 is an end view of the electrical terminal pin tip 202 of FIG. 6. FIG. 8 is a side view of an electrical terminal pin 204 having a pair of the electrical pin tips 202,202' of FIGS. 6 and 7.

The second electrical terminal pin tip 202 is the same as the first electrical terminal pin tip 102, except the second electrical terminal pin tip 202 has a non-plated substantially flat end 216 which is substantially circular with only one circular edge 218. Further, it has only one curved side 212. The side 212 is convex and comprises a truncated sphere or ellipsoid. The second electrical terminal pin end portion 203 has a pin circumference 205 near or immediately adjacent the pin tip 202 that is substantially circular.

Figure 11:
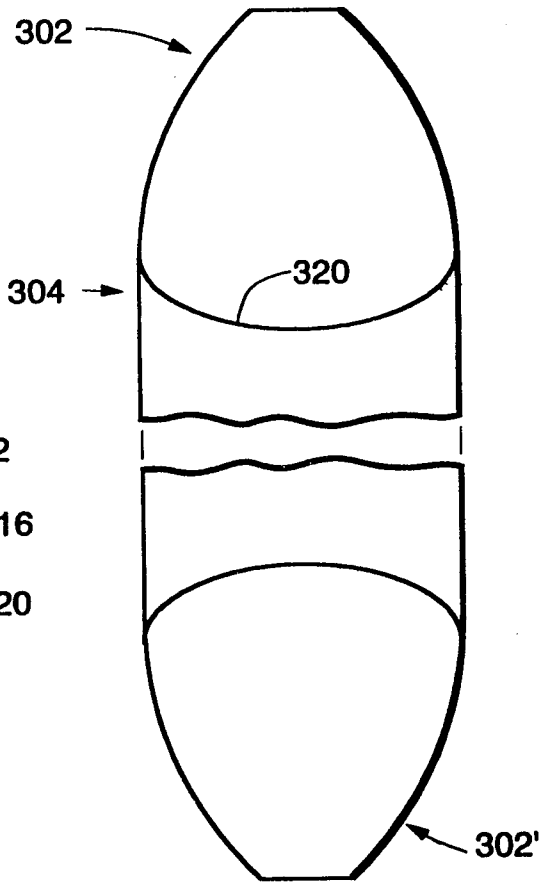
FIG. 11 is a side view of an electrical terminal pin having a pair of the electrical pin tips of FIGS. 9 and 10.
Figure 10:
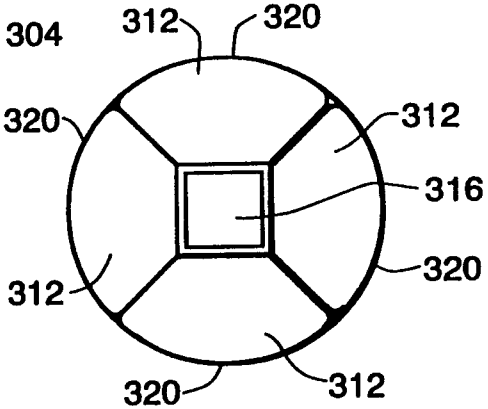
FIG. 10 is an end view of the electrical terminal pin tip of FIG. 9.
Figure 9:
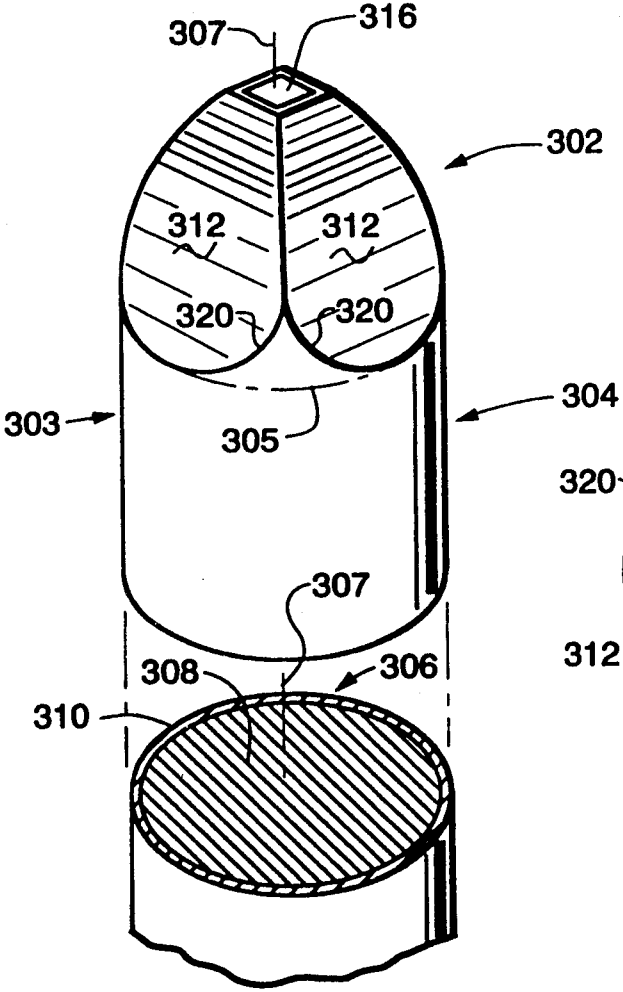
FIG. 9 is an enlarged perspective view of a third embodiment of an electrical terminal pin tip on an end portion of an electrical terminal pin with a portion broken away to show a cross section of the pin in accordance with the present invention.

FIG. 9 is an enlarged perspective view of a third embodiment of an electrical terminal pin tip 302 on an end portion 303 of an electrical terminal pin 304 with a portion broken away to show a cross section 306 of the pin 304 in accordance with the present invention. FIG. 10 is an end view of the electrical terminal pin tip 302 of FIG. 9. FIG. 11 is a side view of the electrical terminal pin 304 having a pair of the electrical pin tips 302,302' of FIGS. 9 and 10.

The third electrical terminal pin 304 has a first pin tip 302 connected to an electrical terminal pin end portion 303. The first pin tip 302 is the same as the first pin tip 102 illustrated in FIGS. 3-5, except where the first pin tip 302 joins the end portion 303. The pin end portion 303 is the same as the pin end portion 203 illustrated in FIGS. 6 and 8, except where the pin end portion 303 joins the pin tip 302. The electrical terminal pin tip 302 has a non-plated substantially flat end 316 which is substantially square. The electrical terminal pin tip 302 has four convex sides 312. The electrical terminal pin portion 303 has a pin perimeter 305 near or immediately adjacent the pin tip 302 that is substantially circular. The plated four convex sides 312 intersect the circular pin perimeter 305 at arced edges 320. Each end of the arced edges 320 intersects with an end of an adjacent one of the arced edges 320.

The electrical terminal pins 104,204,304 of the present invention can be made from any suitable metal used for electrical terminals, such as brass, phosphor bronze, beryllium copper and the like. The electrical terminal pins 104,204,304 may be plated or coated with any conductive layer 110,210,310, such as tin, nickel, palladium, gold, silver or a suitable alloy.

The electrical terminal pins 104,204,304 of the present invention can be made from a plated wire. The wire can be swaged around its perimeter or circumference forming a pair of the pin tips 102,202,302 at the same time connected together at their flat ends 116,216,316. Adjacent pins can be separated by applying opposing lateral forces on the pins or by twisting one with respect to the other.

Figure 1:
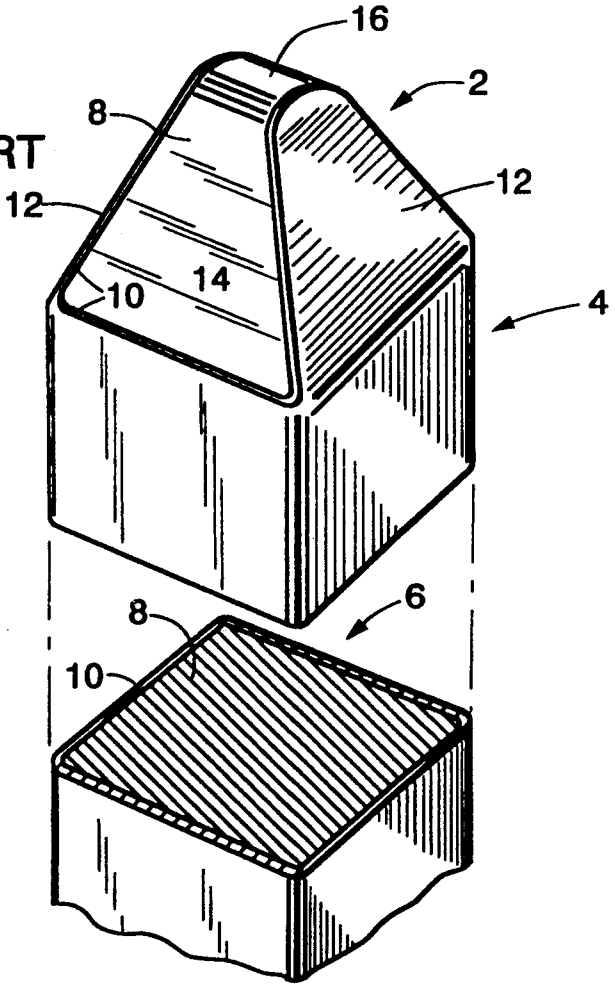
Fig. 1 PRIOR ART
FIG. 1 is an enlarged perspective view of an electrical terminal pin tip of a prior art electrical terminal pin with a portion broken away to show a cross section of the pin.

The first, second and third electrical terminal pin tips 102,202,302, respectively, of the present invention have a greater mechanical advantage than the prior art tip 2 illustrated in FIGS. 1 and 2. This is the case because the slope of the sides 112,212,312 progressively decreases from the flat end 116,216,316 to the ends or arcs 320 of the sides 112,212,312 intersecting the circumference 105,205,305. Thus, when the tip 102,202,302 is almost entirely inserted in the plated through hole or the mating female terminal, the slope of the side(s) 112,212,312 is providing a reduced longitudinal opposing force than the prior art pin 4 when the prior art pin 4 is inserted the same distance in the plated through hole or the mating female terminal. In other words, the longitudinal insertion force required to insert a pin with the first pin tip 102, the second pin tip 202 or the third pin tip 302, tip first into, for instance, a plated through hole or a mating female terminal, is less than the longitudinal insertion force required to insert the pin 4 illustrated in FIGS. 1 and 2 tip first. Further, the lateral retention force applied on the first pin 104, the second pin 204 or the third pin 304 by a plated through hole or a mating female terminal is the same or substantially the same as the lateral retention force applied on the pin 4 illustrated in FIGS. 1 and 2.

Figure 12:
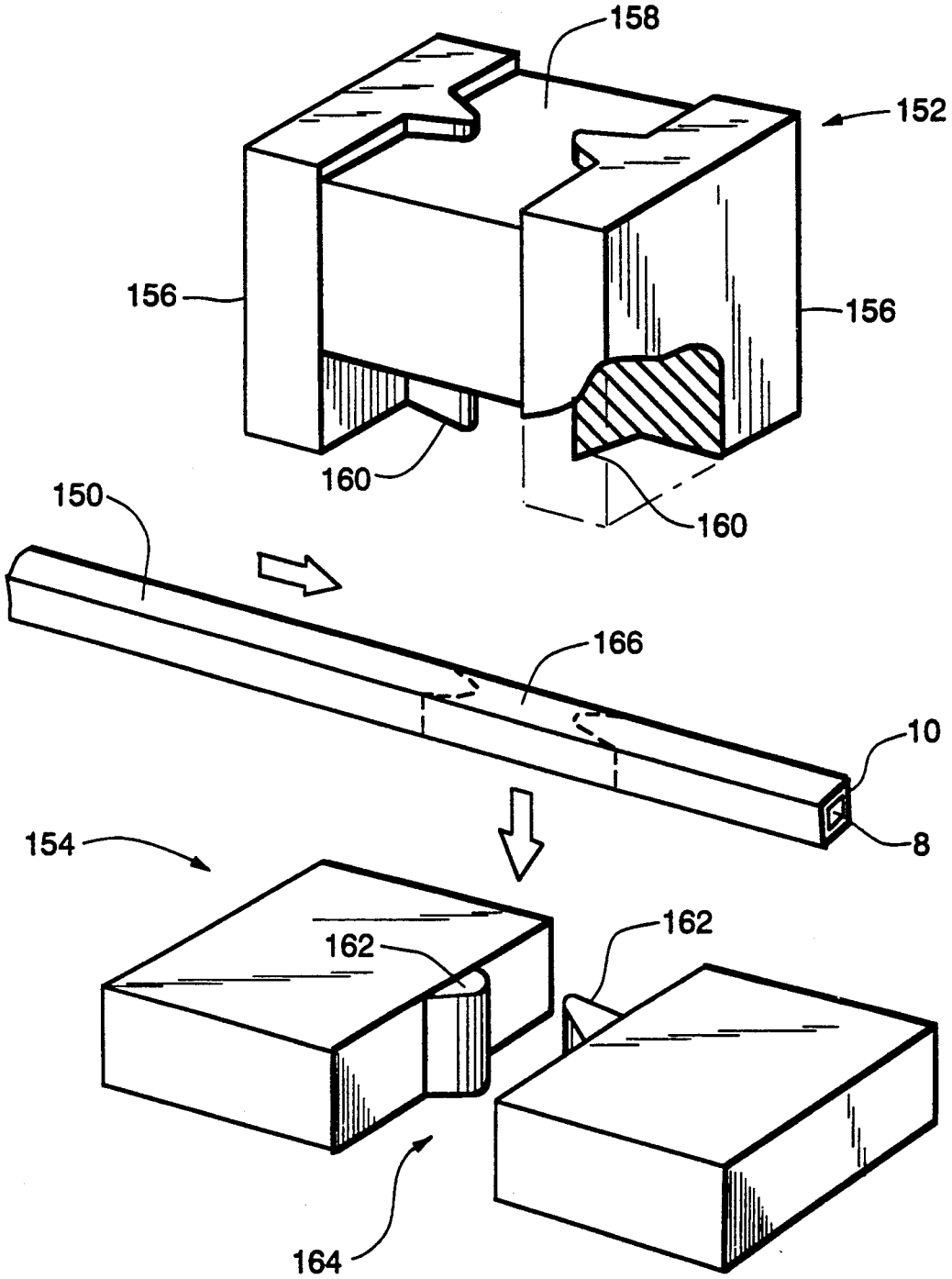
FIG. 12 schematically illustrates a process of manufacturing the electrical pin tip of FIGS. 1 and 2.

One method and associated apparatus for making the prior art pin 4 (illustrated in FIGS. 1 and 2) is schematically illustrated in FIG. 12. A preplated wire 150 comprising the core 8 plated with the layer 10 is fed to a forming position between a punch assembly 152 and a die assembly 154. The punch assembly 152 comprises a pair of opposed swage punches 156 spaced apart by a trim punch 158. The swage punches 156 have punch projections 160 with inclined surfaces for pressing against one (such as a top) surface of the wire 150. The die assembly 154 also has a pair of die projections 162 with inclined surfaces for pressing against another (such as a bottom) surface of the wire 150. In a stamping, swaging or coining action, the wire 150 is swatted or compressed between the punch assembly 152 and the die assembly 154. The punch projections 160 and the die projections 162 contact the top and bottom surfaces of the wire 150 forming the plated sides 12 of a pair of pin tips 2. Then in the same punch stroke, the trim punch 158 slides down with respect to the swage punches 156 into a space 164 between the die projections 162 of the die assembly 154 forming the trimmed sides 14 and the trimmed curved end surface 16 completing the forming of the pair of the pin tips 2. In this process, for each pair of tips 2 formed, a segment 166 of the wire 150 positioned between the material from which the tips 2 are formed is discarded as waste or further processed to separate and recover the core 8 and plating 10 materials for reuse. It is desirable to make pin tips in a process where there is no wire segment discarded as waste or further processed or recycled to recover raw materials.

Figure 13:
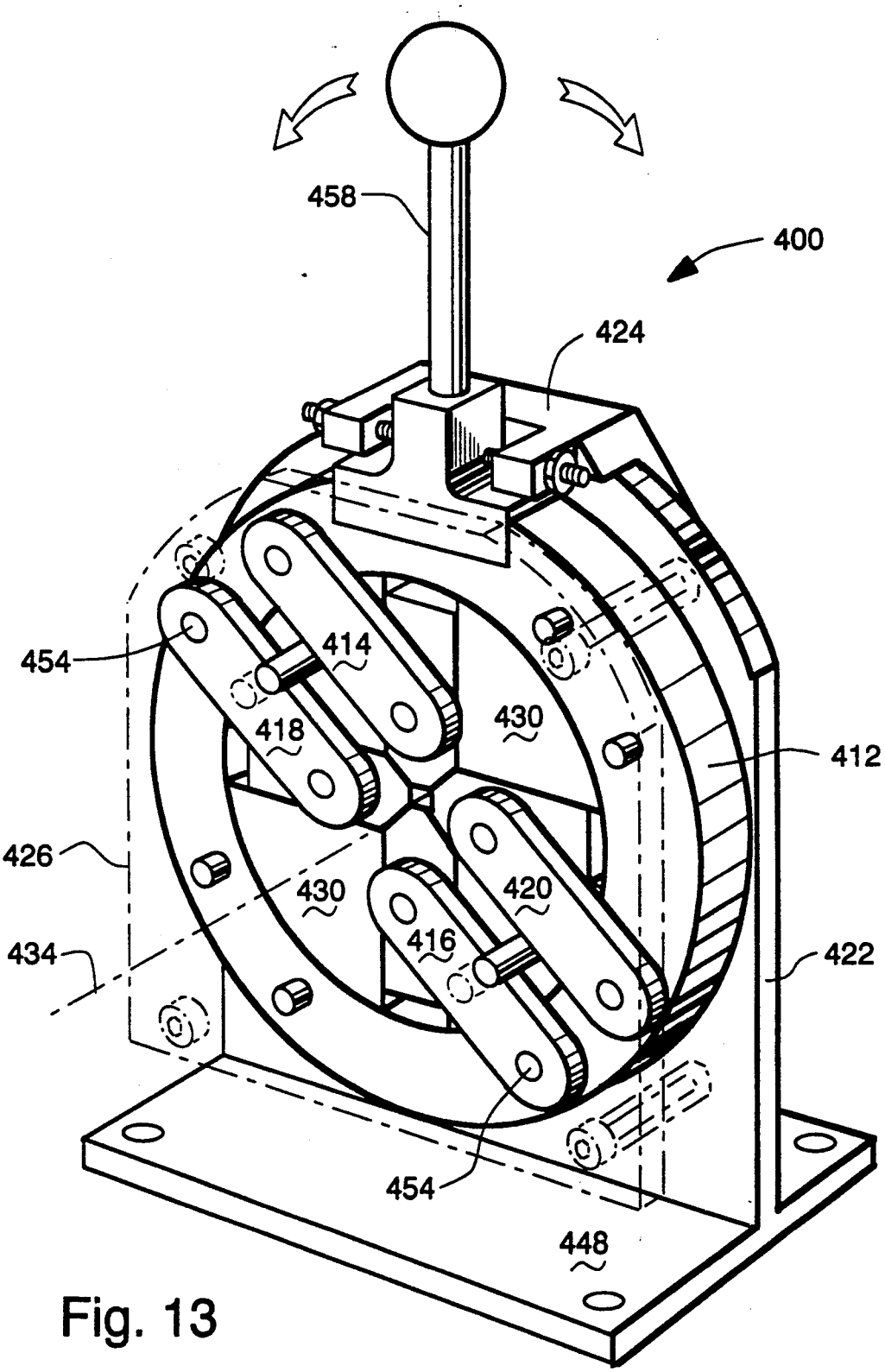
FIG. 13 is a perspective view of a multi-swat apparatus in accordance with the present invention.
Figure 14:
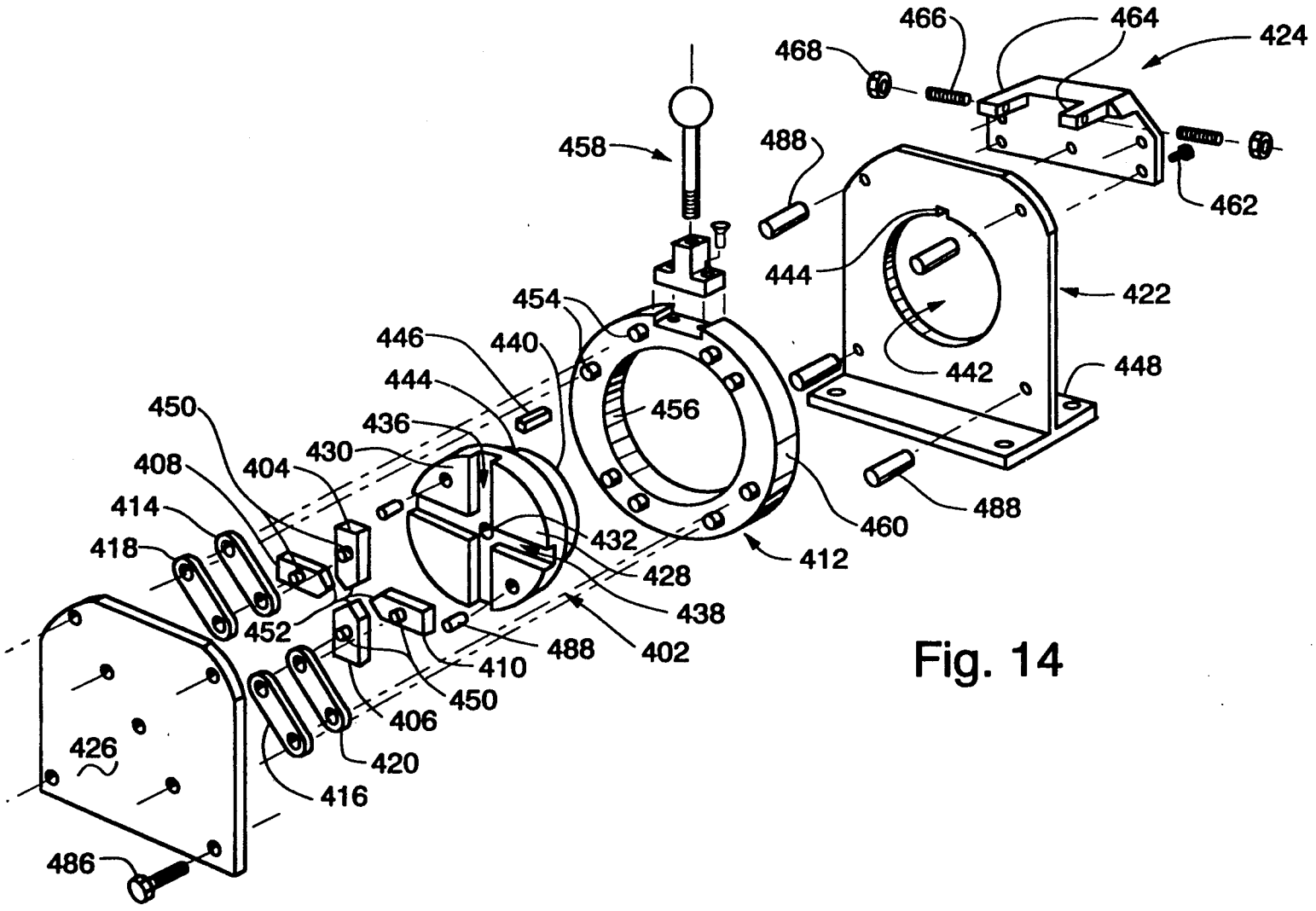
FIG. 14 is an exploded perspective view of the multi-swat apparatus of FIG. 13.

As such, the present invention is directed to methods and apparatus for making electrical terminal pins, such as pins 104,204,304, where there is no wire segment discarded as waste or further processed or recycled to recover raw materials. Referring to FIG. 13, there is a perspective view of a multi-swat apparatus 400 for forming a feature on an elongated preplated metal wire in accordance with the present invention. FIG. 14 is an exploded perspective view of the multi-swat apparatus 400 of FIG. 13. The multi-swat apparatus 400 can be used to perform a stamping, coining or swaging operation on an elongated metal wire to form the feature, such as a pair of the pin tips 102,202,302 illustrated in FIGS. 3–5, 6–8 or 9–11, respectively.

The multi-swat apparatus 400 comprises a tool guide 402, a first forming tool 404, a second forming tool 406, a third forming tool 408, a fourth forming tool 410, a ring 412, a first link 414, a second link 416, a third link 418, and a fourth link 420. Optionally, the multi-swat apparatus 400 may also comprise a support 422, a stop assembly 424, and a cover shield 426.

The tool guide 402 has a first surface 428, a second surface 430 and a passage 432. The first surface 428 is cylindrical about an axis 434. The second surface 430 is connected to one end of the cylindrical surface 428. The second surface 430 has a first straight slot 436 and a second straight slot 438 recessed in the second surface 430 and intersecting one another at the axis 434. The passage 432 extends through the tool guide 402 along the axis 434. The tool guide 402 further has a cylindrical hub 440 for insertion in a mating circular hole 442 through the support 422. The hub 440 and the support 422 have mating key slots 444 for receiving a key 446 to prevent rotation of the hub 440 with respect to the support 422.

Alternatively, the support 422 can be integral or one piece with the tool guide 402. The support 422 can have a T-flange 448 for mounting the support 422 to another structure, such as a table.

The first forming tool 404 and the second forming tool 406 are pivotally or slideably positioned in the first slot 436 across the axis 434 from one another. The third forming tool 408 and the fourth forming tool 410 are pivotally or slideably positioned in the second slot 438 across the axis 434 from one another. Each one of the first, second, third and fourth forming tools 404,406,408,410 have a projection or pin 450 extending away from the tool guide 402. Each one of the first, second, third and fourth forming tools 404,406,408,410 further have a working end 452 for contacting the wire and conforming the contacted wire to the shape of the working end 452. The working ends 452 illustrated in FIG. 16A through FIG. 16D are configured as a mold for forming a pair of the pin tips 102 illustrated in FIGS. 3–5 connected end to end at their non-plated substantially flat ends 116.

The ring 412 has a plurality of projections or pins 454 and an inner cylindrical surface 456 for contacting the tool guide cylindrical surface 428. The ring 412 is capable of oscillating around the axis 434 with respect to the tool guide 402 by sliding on the cylindrical guide surface 428.

An extension, pin or lever assembly 458 can be on, connected to or one piece with the ring 412. The extension 458 can, for instance, extend radially from an outer cylindrical surface 460 of the ring 412. Force can be applied to the extension 458 to oscillate the ring 412 with respect to the tool guide 402.

The stop assembly 424 may comprise a bracket for mounting to the support 422, such as, by screws 462. The bracket has legs 464 extending on distal sides of the ring extension 458. The legs 464 have inner surfaces or stops that can function to limit movement or the ring extension 458 to the space between the stops. Threaded shafts or screws 466 can threadedly extend through the legs 464 to provide adjustably positionable stops. Nuts 468 can fix the threaded shafts or screws 466 in place against the legs 464.

Figure 15A:
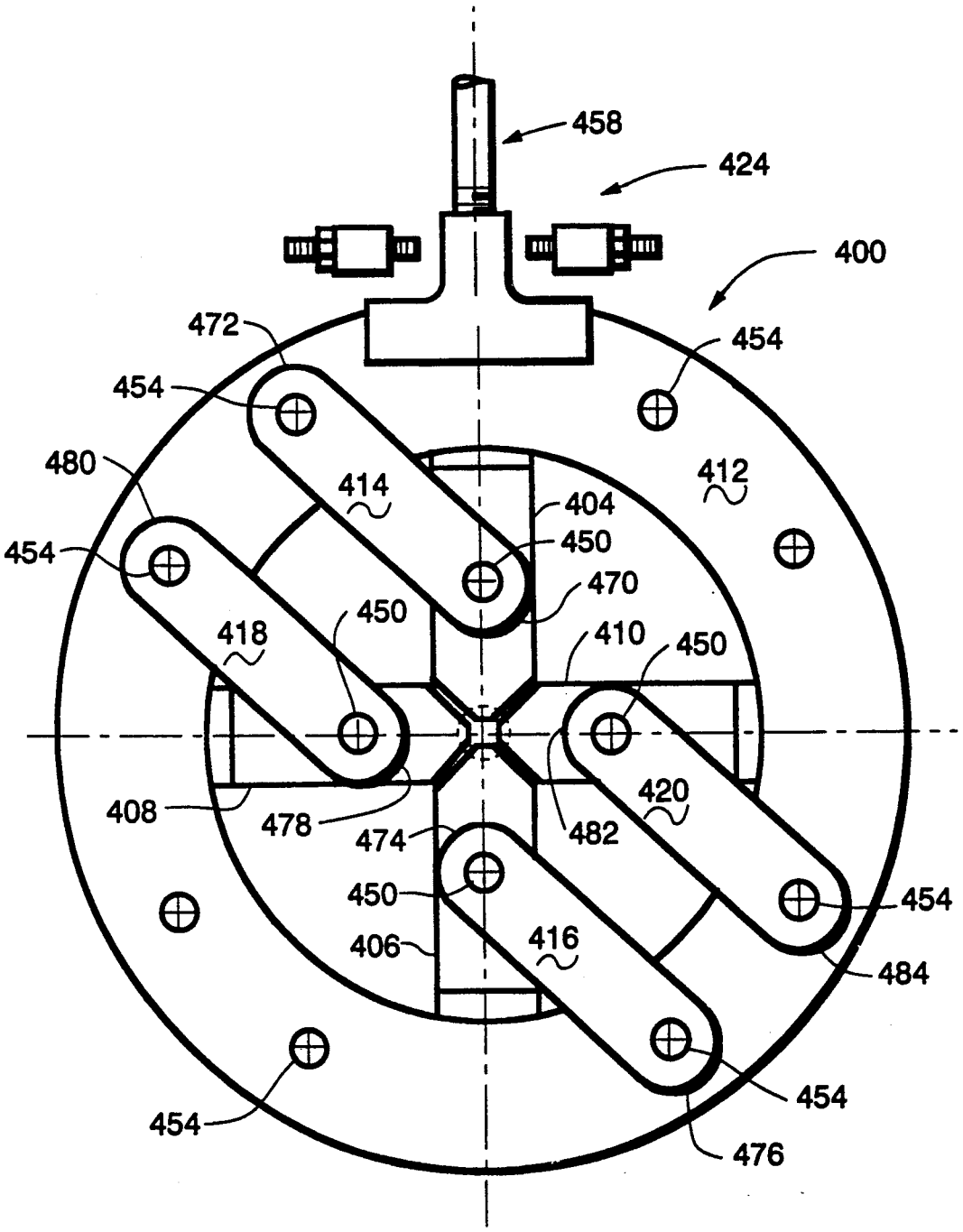
FIG. 15A is a front view of the multi-swat apparatus of FIG. 13 assembled in a first manner and illustrated in a home position.

Referring to FIG. 15A, the first link 414 has a first end 470 and a second end 472. The first end 470 is pivotally connected to the first tool projection 450. Specifically, the first end 470 has a circular hole through it and the first tool projection 450 extends through the first end hole. The second end 472 is pivotally connected to a first one of a first set of four of the ring projections 454. Specifically, the second end 472 has a circular hole through it and the first one of a first set of the ring projections 454 extends through the second end hole.

The second link 416 has a first end 474 and a second end 476. The first end 474 is pivotally connected to the second tool projection 450. Specifically, the first end 474 has a circular hole through it and the second tool projection 450 extends through the first end hole. The second end 476 is pivotally connected to a second one of the first set of the ring projections 454. Specifically, the second end 476 has a circular hole through it and the second one of the first set of the ring projections 454 extends through the second end hole.

The third link 418 has a first end 478 and a second end 480. The first end 478 is pivotally connected to the third tool projection 450. Specifically, the first end 478 has a circular hole through it and the third tool projection 450 extends through the first end hole. The second end 480 is pivotally connected to a third one of the first set of the ring projections 454. Specifically, the second end 480 has a circular hole through it and the third one of the first set of the ring projections 454 extends through the second end hole.

The fourth link 420 has a first end 482 and a second end 484. The first end 482 is pivotally connected to the fourth tool projection 450. Specifically, the first end 482 has a circular hole through it and the fourth tool projection 450 extends through the first end hole. The second end 484 is pivotally connected to a fourth one of the first set of the ring projections 454. Specifically, the second end 484 has a circular hole through it and the fourth one of the first set of the ring projections 454 extends through the second end hole.

The cover shield 426 can be positioned adjacent the links 414,416,418,420. Screws 486 can connect the cover shield 426 to the support 422 and the tool guide 402 with the ring 412, the forming tools 404,406,408,410 and the links 414,416,418,420 sandwiched between the cover shield 426 and the support 422. Spacers 488 can be provided on the screws 486 between the cover shield 426 and the support 422 or the tool guide 402.

Figure 15B:
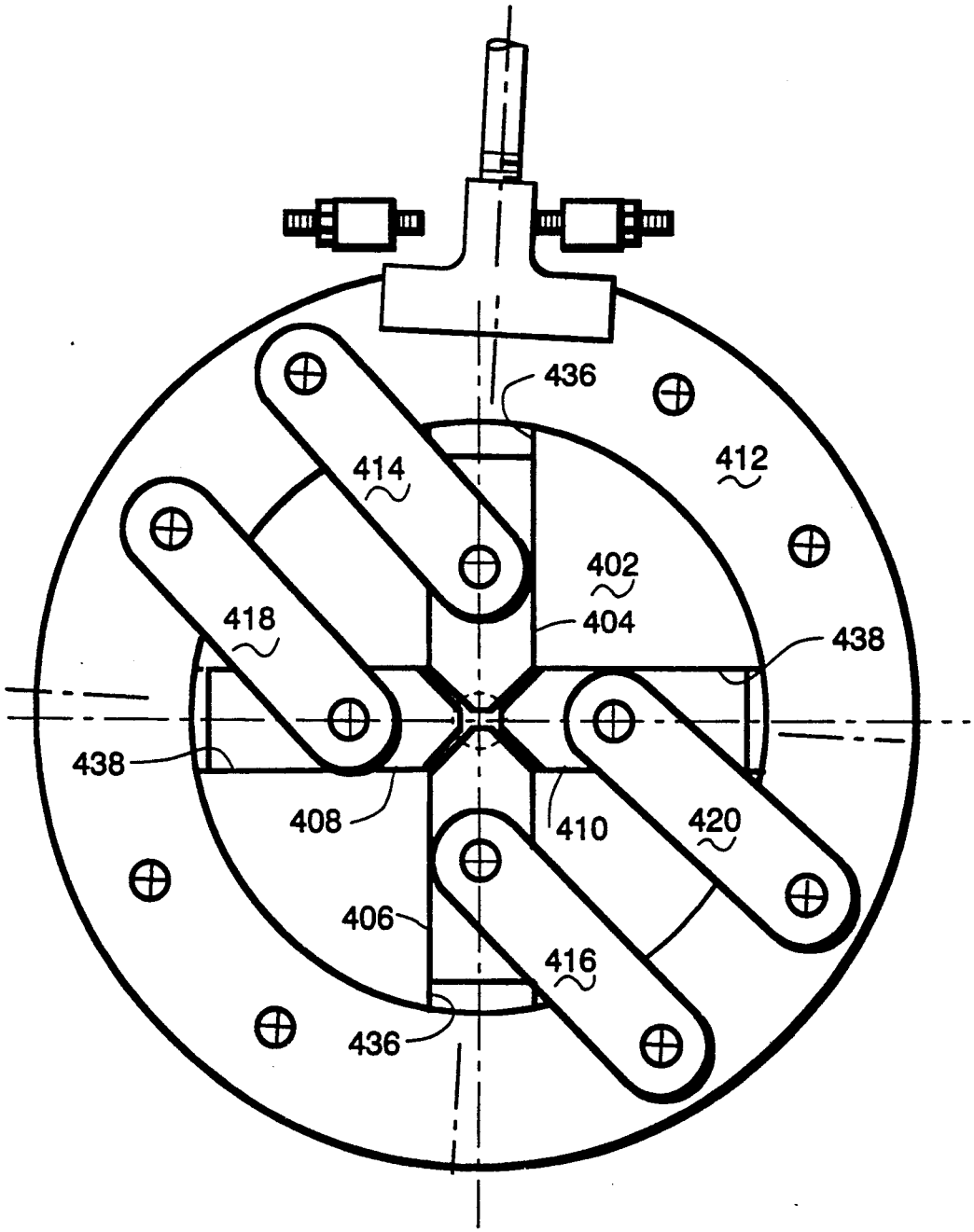
FIG. 15B is a front view of the multi-swat apparatus of FIG. 13 assembled in the first manner and illustrated in a first forming position.
Figure 15C:
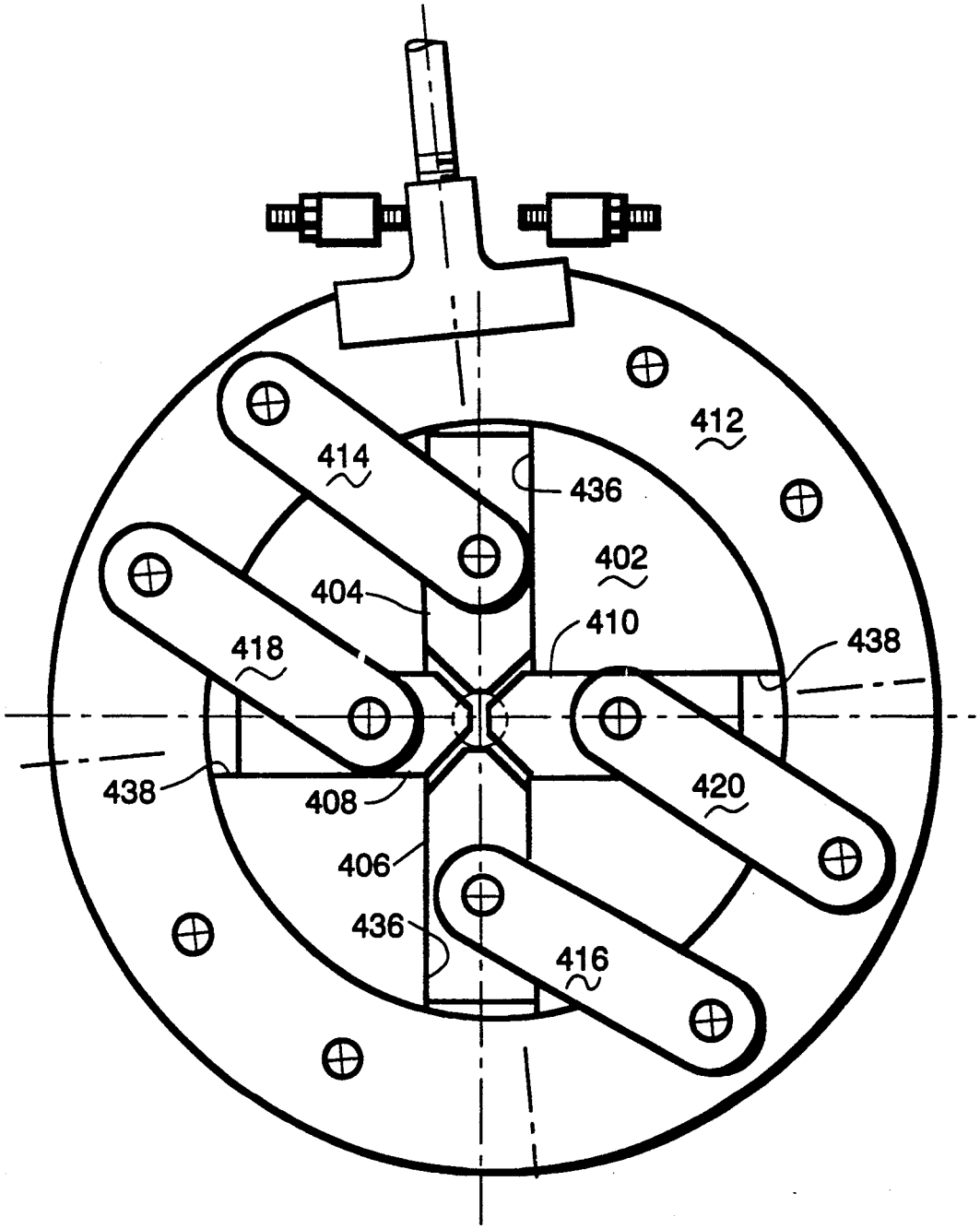
FIG. 15C is a front view of the multi-swat apparatus of FIG. 13 assembled in the first manner and illustrated in a second forming position.

The operation of the above described multi-swat apparatus 400 is illustrated in the first manner or configuration in FIGS. 15A, 15B and 15C. FIG. 15A is a front view of the multi-swat apparatus 400 of FIG. 13 assembled in a first manner or configuration as described above and illustrated in a home position. In the home position, the forming tools 404,406,408,410 are positioned mid-way between their closest position to the axis 434 and their farthest position from the axis 434. In the home position, a preplated wire can be positioned in the passage 432 such that the wire extends out of the slots 436,438.

FIG. 15B is a front view of the multi-swat apparatus 400 of FIG. 13 assembled in the first manner and illustrated in a first forming position. As illustrated in FIG. 15B, the ring 412 is oscillated or rotated from the home position in a first direction (clockwise in FIG. 15B) with respect to the tool guide 402. This causes the first and second forming tools 404,406 to be forced by the links 414,416 to slide in the first slot 436 towards the axis 434 into contact with a first pair of distal sides of the wire. This further causes the third and fourth forming tools 408,410 to be forced by the links 418,420 to slide in the second slot 438 away from the axis 434.

FIG. 15C is a front view of the multi-swat apparatus 400 of FIG. 13 assembled in the first manner and illustrated in a second forming position. As illustrated in FIG. 15B, when the ring 412 is oscillated or rotated from the first forming position or the home position in a second direction (opposite to the first direction) with respect to the tool guide 402, the third and fourth forming tools 408,410 are forced by the links 418,420 to slide in the second slot 438 towards the axis 434 into contact with a second pair of distal sides of the wire. At the same time, the first and second forming tools 404,406 are forced by the links 414,416 to slide in the first slot 436 away from the axis 434.

As seen in FIGS. 15A, 15B and 15C, longitudinal axis of the links 414,416,418,420 are parallel or substantially parallel in the home position, the first forming position and the second forming position when the multi-swat apparatus 400 is in the first configuration.

FIGS. 16A–16G schematically illustrate steps in a process for forming a feature on an elongated metal wire 500 where the feature is a pair of the electrical pin tips 102 of FIGS. 3–5.

Figure 16A:
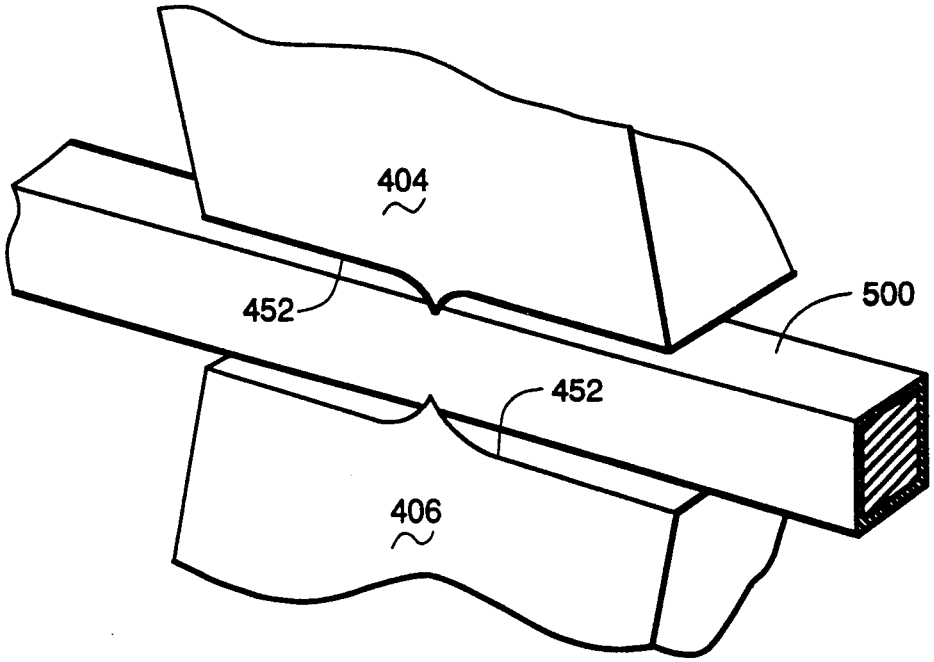
FIGS. 16A–16G schematically illustrate steps in a process of making a pair of the electrical pin tips of FIGS. 3–5 in accordance with the present invention.

FIG. 16A illustrates a first step of simultaneously stamping a first pair of distal sides of the wire 150 between the working end 452 of the first forming tool 404 and the working end 452 of the second forming tool 406 such that the working ends 452 press into the first pair of the distal sides a first distance.

Figure 16B:
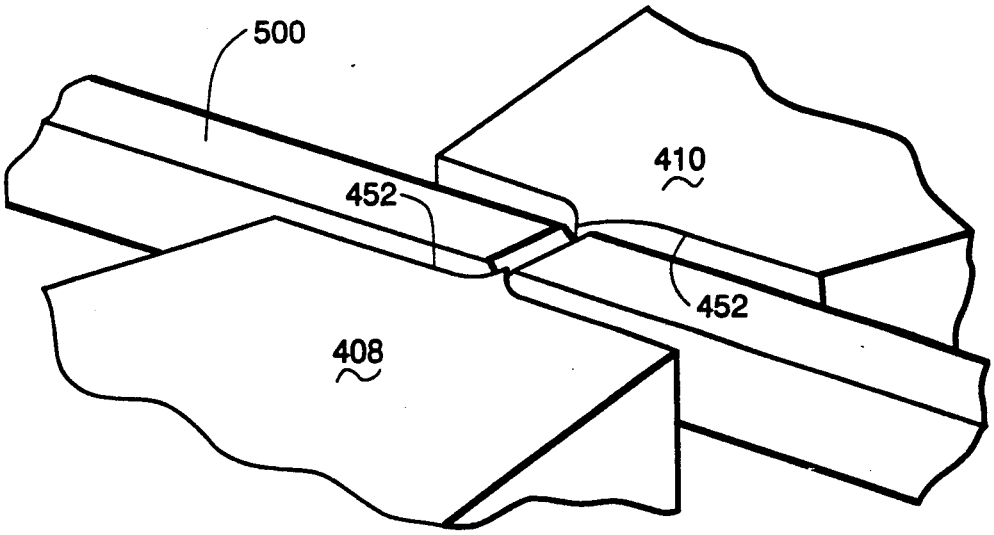

FIG. 16B illustrates a step of simultaneously stamping a second pair of distal sides of the wire 500 between the working end 452 of the third forming tool 408 and the working end 452 of the fourth forming tool 410 such that the working ends 452 press into the second pair of the distal sides a second distance.

Figure 16C:
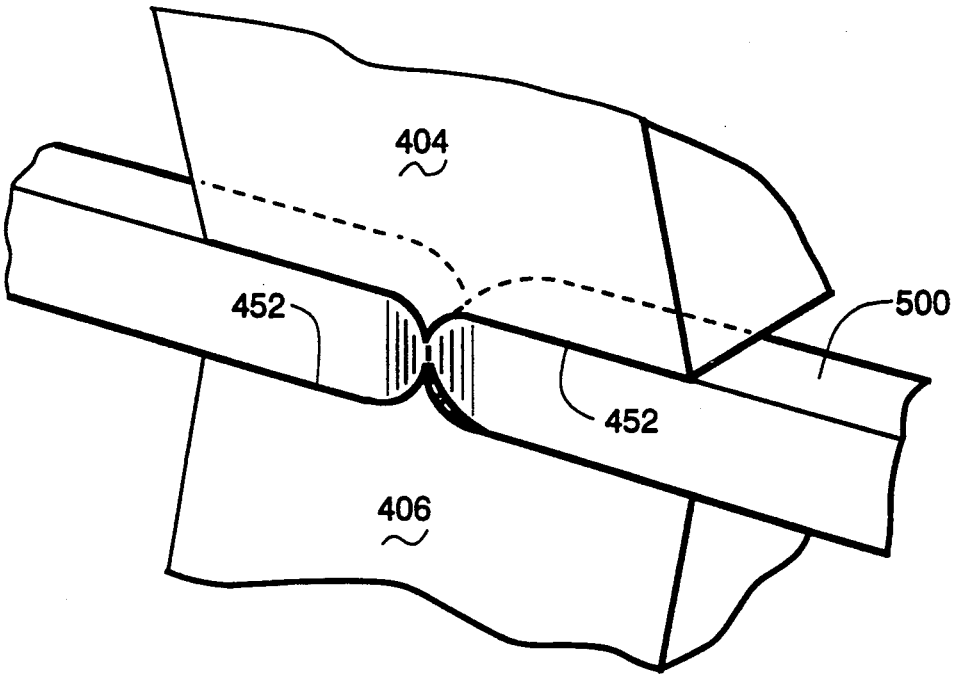

FIG. 16C illustrates a step of simultaneously stamping the first pair of the distal sides of the wire 500 between the working end 452 of the first forming tool 404 and the working end 452 of the second forming tool 406 such that the working ends 452 press into the first pair of the distal sides a third distance.

Figure 16D:
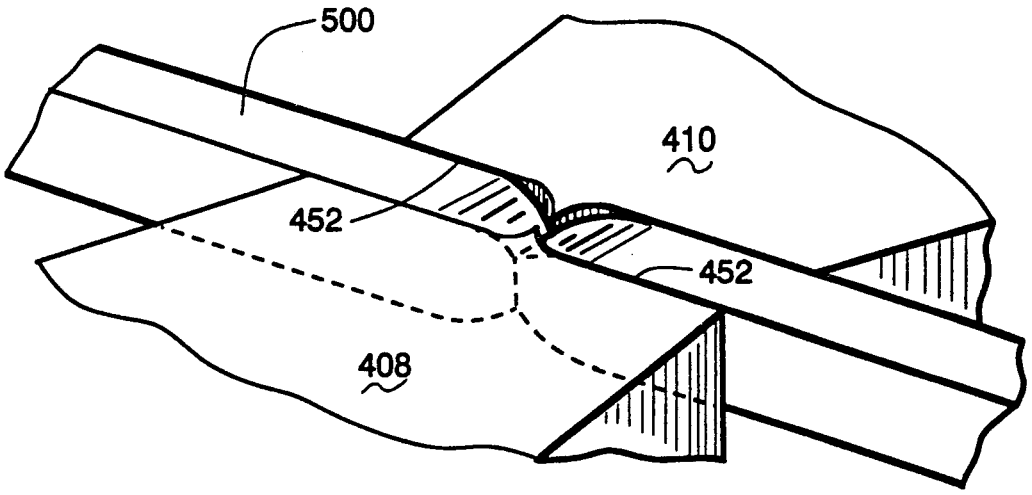

FIG. 16D illustrates a step of simultaneously stamping the second pair of distal sides of the wire 500 between the working end 452 of the third forming tool 408 and the working end 452 of the fourth forming tool 410 such that the working ends 452 press into the second pair of the distal sides a fourth distance forming the feature in the sides of the metal wire 500.

Preferably, the first and second distances are the same or substantially the same. Preferably, the third and fourth distances are the same or substantially the same. Further preferably, the third and fourth distances are greater than the first and second distances.

One or more additional stamping steps can be performed on the wire 500 where the distances that the forming tools 404,406,408,410 press into the sides of the wire 500 increases each time a pair or all the wire sides are stamped. For instance, after the stamping step illustrated in FIG. 16D, another step of simultaneously stamping can be performed where the first pair of the distal sides of the wire is stamped by and between the working end 452 of the first forming tool 404 and the working end 452 of the second forming tool 406 such that the working ends 452 press into the first pair of the distal sides a fifth distance which is greater than the fourth distance. Then the second pair of distal sides of the wire 500 can be stamped by and between the working end 452 of the third forming tool 408 and the working end 452 of the fourth forming tool 410 such that the working ends 452 press into the second pair of the distal sides the fifth distance.

In addition or alternatively, one or more additional stamping steps can be performed on the wire 500 between stamps at different working end distances such that the distances that the forming tools 404,406,408,410 press into the sides of the wire 500 remains the same as an immediately preceding stamping step each time a pair or all the sides are stamped. For instance, the third and fourth stamping steps can be repeated one or more times to provide a smoother surface on the feature. In any event, after all the wire sides have been stamped once with the forming tools 404,406,408,410 pressing their greatest distance into the wire sides, it is preferred that all of the sides be stamped one or more additional times with the forming tools 404.406,408,410 pressing their greatest distance into the wire sides. Repetitious stamping by the forming tools 404,406,408,410 at the same distance makes the surface of the wire feature being formed smoother.

Figure 16E:
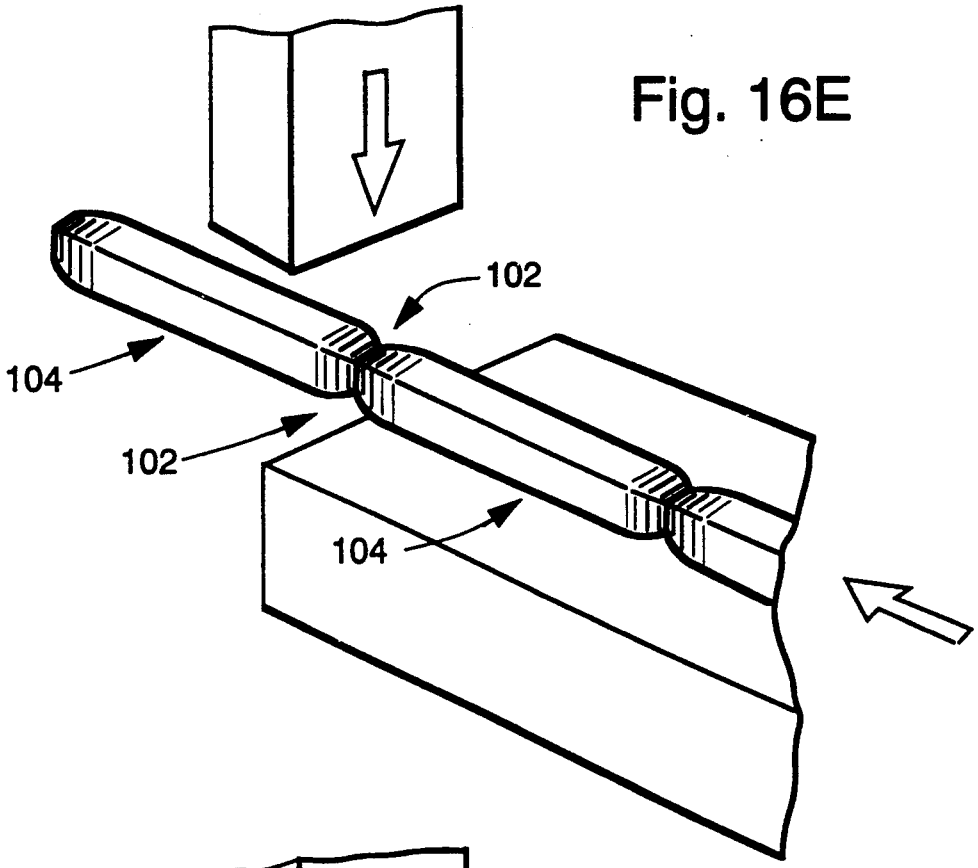
Figure 16F:
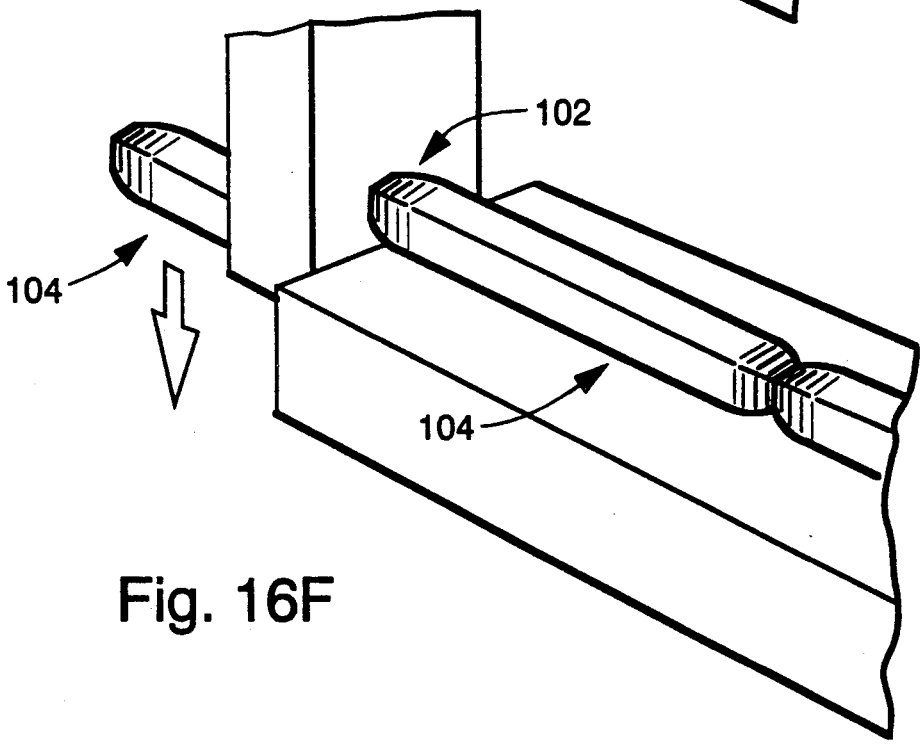
Figure 16G:
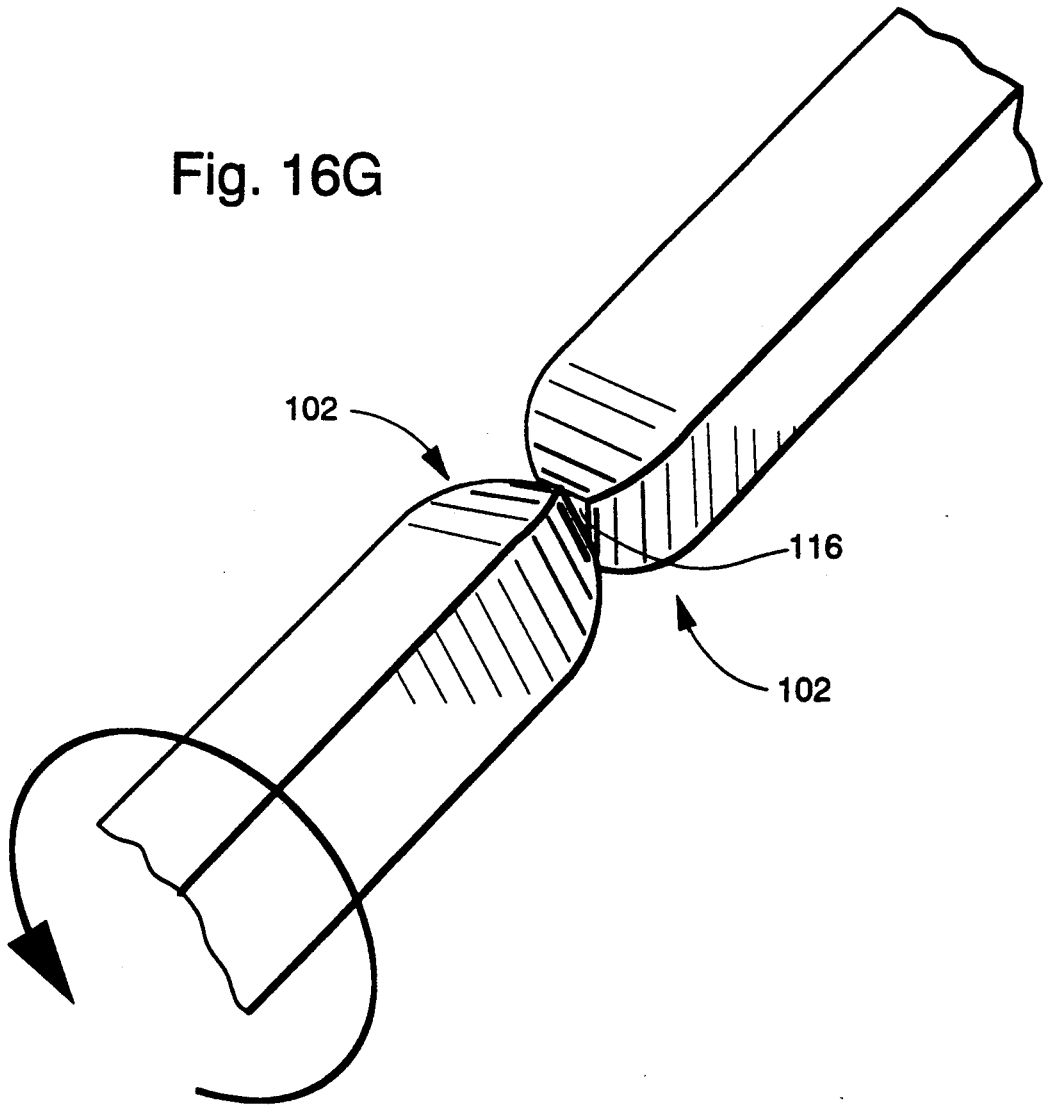

FIGS. 16E and 16F illustrate a further optional step of applying a force substantially perpendicular to the axis of symmetry near one of the pin tips 102 with respect to the other one of the pin tips 102 to shear the pin tips 102 apart forming the non-plated substantially flat ends of two pin tips 102. FIG. 16G illustrates an alternative way of separating the connected pin tips 102. Specifically, FIG. 16G illustrates the step of rotating one of the pin tips 102 about the axis of symmetry with respect to the other one of the pin tips 102 to break the pin tips 102 apart forming the non-plated substantially flat ends 116 of two pin tips 102.

When the multi-swat apparatus 400 of FIG. 13 is assembled in the first manner as described above and as depicted in FIGS. 15A, 15B and 15C, the second stamping step is performed after the first stamping step; and the fourth stamping step is performed after the third stamping step.

However, the multi-swat apparatus 400 can be assembled in a second manner or configuration such that the second stamping step is performed simultaneously with the first stamping step; and the fourth stamping step is performed simultaneously with the third stamping step.

Figure 17A:
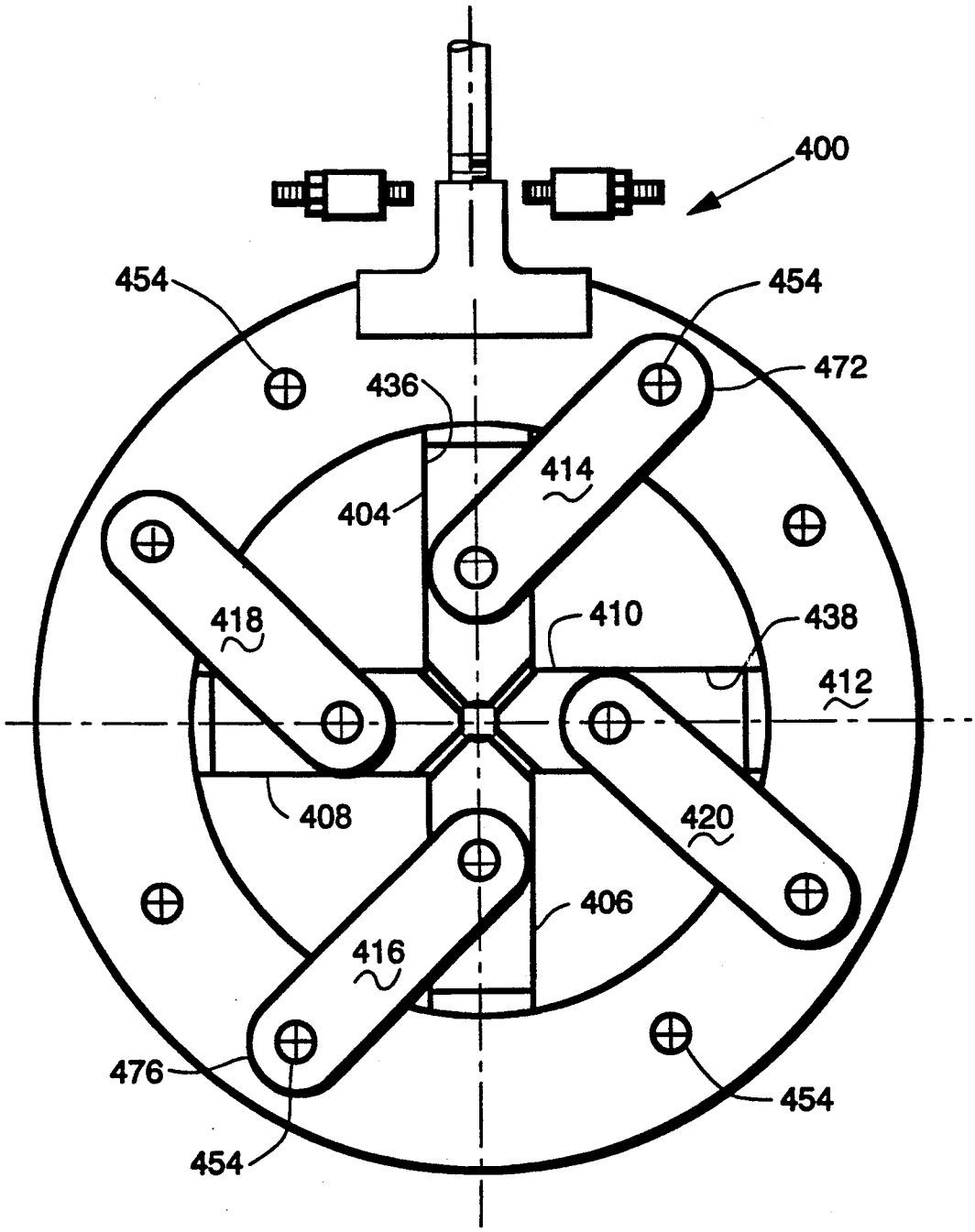
FIG. 17A is a front view of the multi swat apparatus of FIG. 13 assembled in a second manner and illustrated in a home position.
Figure 17B:
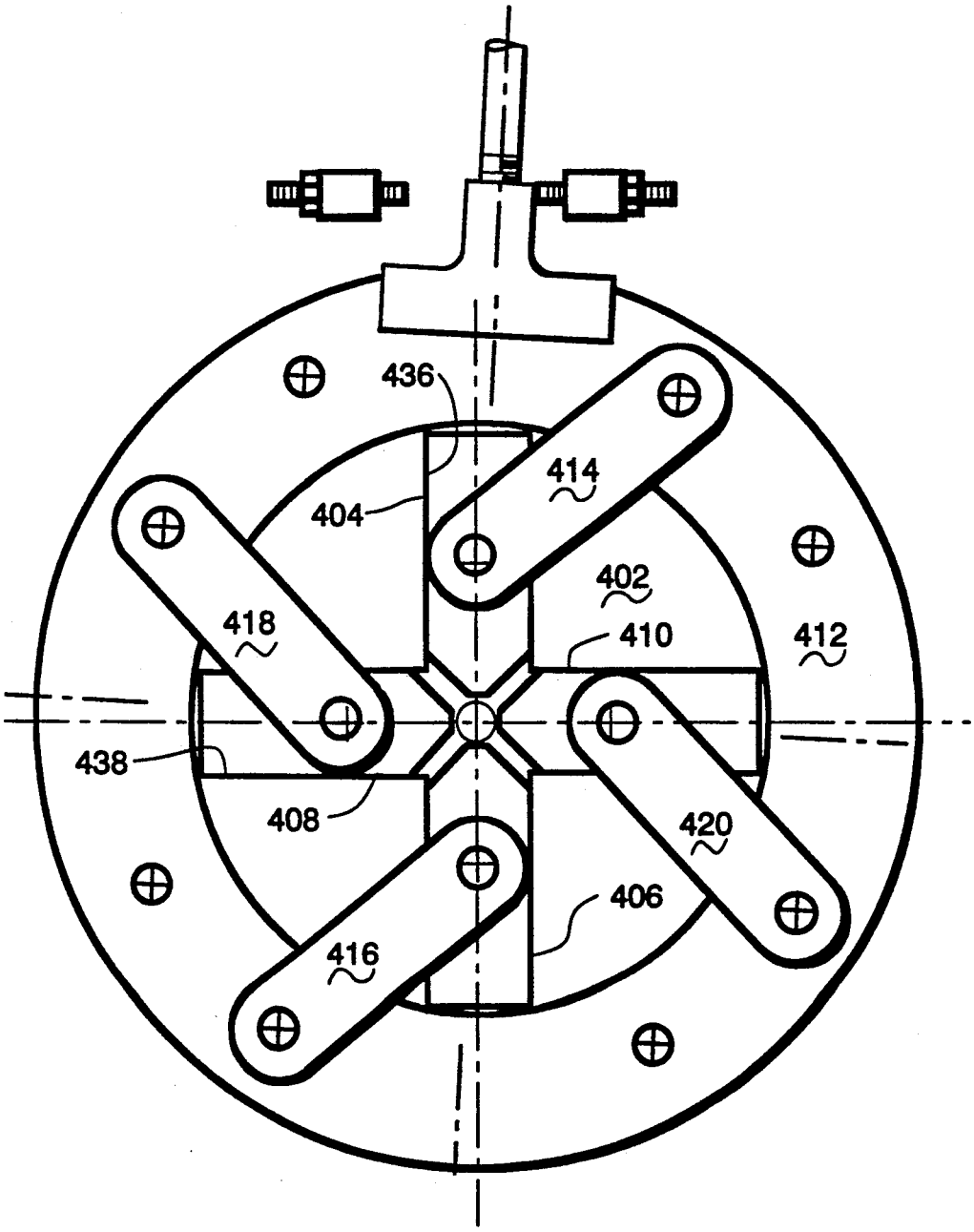
FIG. 17B is a front view of the multi-swat apparatus of FIG. 13 assembled in the second manner and illustrated in a first forming position.
Figure 17C:
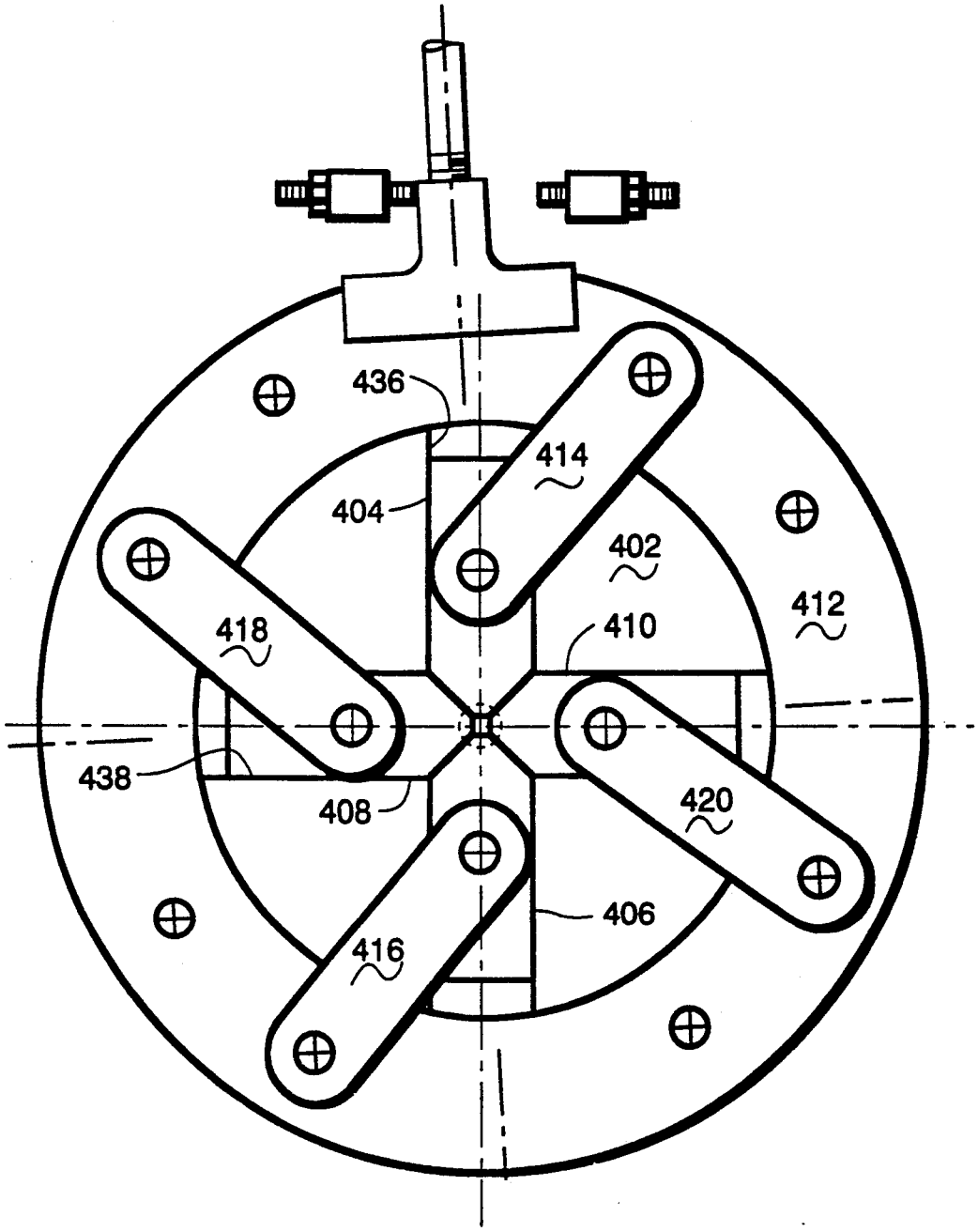
FIG. 17C is a front view of the multi-swat apparatus of FIG. 13 assembled in the second manner and illustrated in a second forming position.

FIGS. 17A, 17B and 17C are provided to illustrate the multi-swat apparatus 400 assembled in the second manner or configuration and its associated operation. Specifically, the ring 412 has a second set of four of the projections 454. A first one and a fourth one of the second set of the projections 454 are positioned on the ring 412 between the first one of the first set of the ring projections 454 and the fourth one of the first set of the ring projections 454. The first one of the second set of the projections 454 is closer to the first one of the first set of the projections 454 (than the fourth one of the second set of the projections 454) and the fourth one of the second set of the projections 454 is closer to the fourth one of the first set of the projections 454 (than the first one of the second set of the projections 454). A second one and a third one of the second set of the projections 454 are positioned on the ring 412 between the second one of the first set of the ring projections 454 and the third one of the first set of the ring projections 454. The second one of the second set of the projections 454 is closer to the second one of the first set of the projections 454 (than the third one of the second set of the projections 454) and the third one of the second set of the projections 454 is closer to the third one of the first set of the projections 454 (than the second one of the second set of the projections 454). In the second configuration, the second end 472 of the first link 414 is pivotally connected to the first one of the second set of the ring projections 454, rather than being pivotally connected to the first one of the first set of the ring projections 454. Further, in the second configuration, the second end 476 of the second link 416 is pivotally connected to the second one of the second set of the ring projections 454, rather than being pivotally connected to the second on of the first set of the ring projections 454.

FIG. 17A is a front view of the multi-swat apparatus 400 of FIG. 13 assembled in the second manner and illustrated in a home position. As in the first configuration, in the home position of the second configuration, the forming tools 404,406,408,410 are positioned midway between their closest position to the axis 434 and their farthest position from the axis 434. In the home position, a preplated wire can be positioned in the passage 432 such that the wire extends out of the slots 436,438.

FIG. 17B is a front view of the multi-swat apparatus 400 of FIG. 13 assembled in the second manner and illustrated in a first forming position. As illustrated in FIG. 17B, the ring 412 is oscillated or rotated from the home position in a first direction with respect to the tool guide 402. This causes the first, second third and fourth forming tools 404,406,408,410 to be forced by the links 414,416,418,420 to slide in the first and second slots 436,438 away from the axis 434.

FIG. 17C is a front view of the multi-swat apparatus 400 of FIG. 13 assembled in the second manner and illustrated in a second forming position. As illustrated in FIG. 17B, when the ring 412 is oscillated or rotated from the first forming position or the home position in a second direction (opposite to the first direction) with respect to the tool guide 402, the first, second, third and fourth forming tools 404,406,408,410 are forced by the links 414,416,418,420 to slide in the first and second slots 436,438 towards the axis 434 into contact with sides of the wire (if positioned in the multi-swat apparatus 400).

As seen in FIGS. 17A, 17B and 17C, longitudinal axes of the first and second links 414,416 are perpendicular or substantially perpendicular to longitudinal axes of the third and fourth links 418,420 in the home position, the first forming position and the second forming position when the multi-swat apparatus 400 is in the second configuration.

The working ends 452 of the forming tools 404,406,408,410 can be configured to mold any feature in the sides of a wire. Other specific features contemplated include (1) other configurations of pairs of pin tips connected end to end, (2) compliant or press-fit sections for being forced and deformed in a hole in a connector housing or a plated through hole in a printed circuit board providing an interference fit therebetween or (3) a relatively nondeformable retention section for providing an interference fit between a terminal and a connector housing or a plated through hole in a printed circuit board.

Figure 18A:
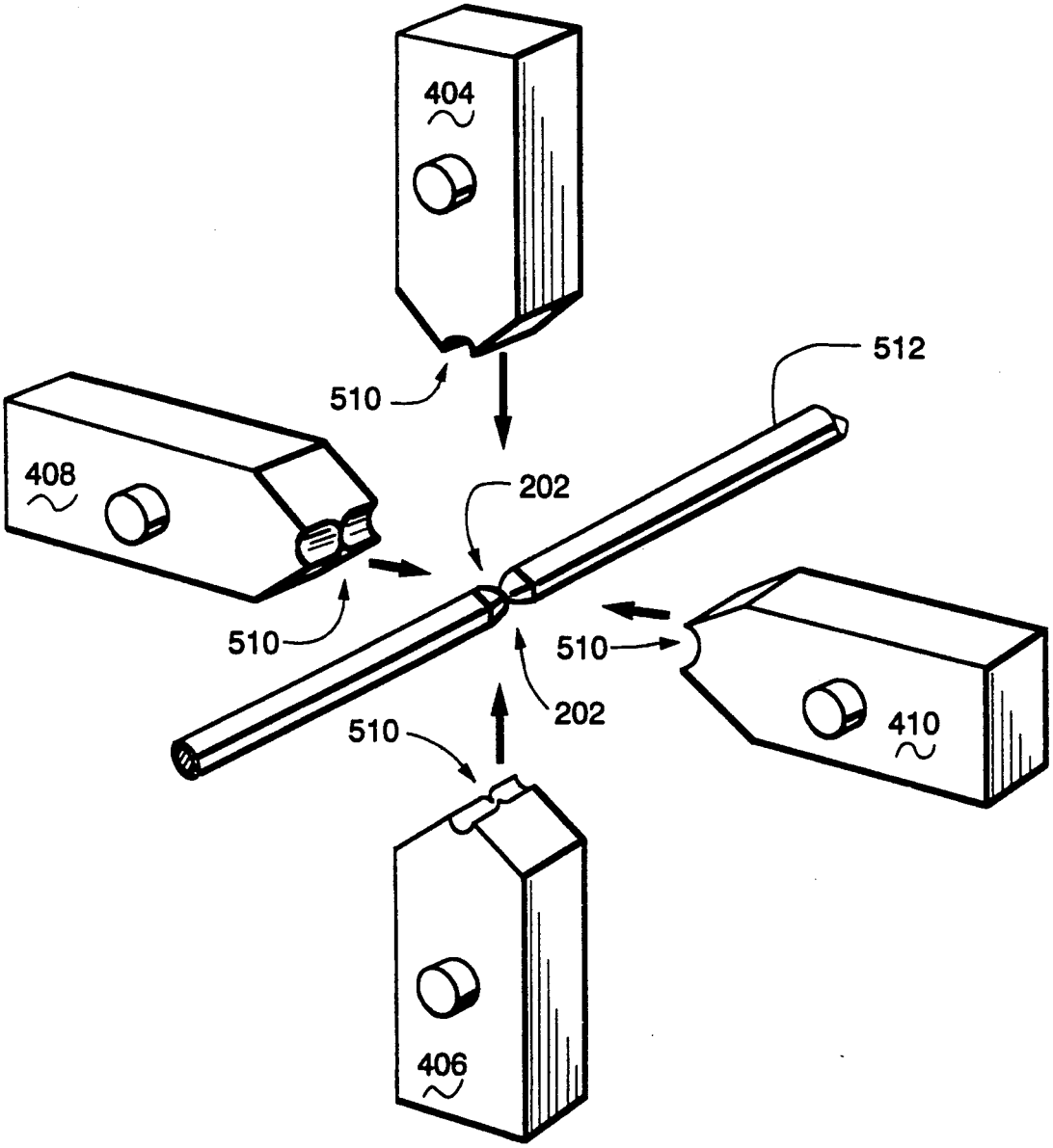
FIG. 18A is an enlarged perspective view of working ends of forming tools for forming a pair of the pin tips illustrated in FIGS. 6–8 connected end to end in a preplated wire.

For instance, FIG. 18A is an enlarged perspective view of working ends 510 of forming tools 404,406,408,410 configured as molds for forming a pair of the pin tips 202 illustrated in FIGS. 6–8 connected end to end in a preplated wire 512. Each one of these four working ends 510 can have a concave spherical or cylindrical contact surface spanning more than 90 degrees, and preferably about 100 degrees. This causes the contact surface of adjacent working ends 510 to overlap on the wire 512 when they alternately stamp the sides of the wire 512. When the concave spherical or cylindrical contact surfaces span more than 90 degrees, the multi-swat apparatus 400 must be arranged in the first configuration illustrated in FIGS. 15A, 15B and 15C where alternating pairs of the four working ends 510 simultaneously swat the wire sides at a time.

Figure 18B:
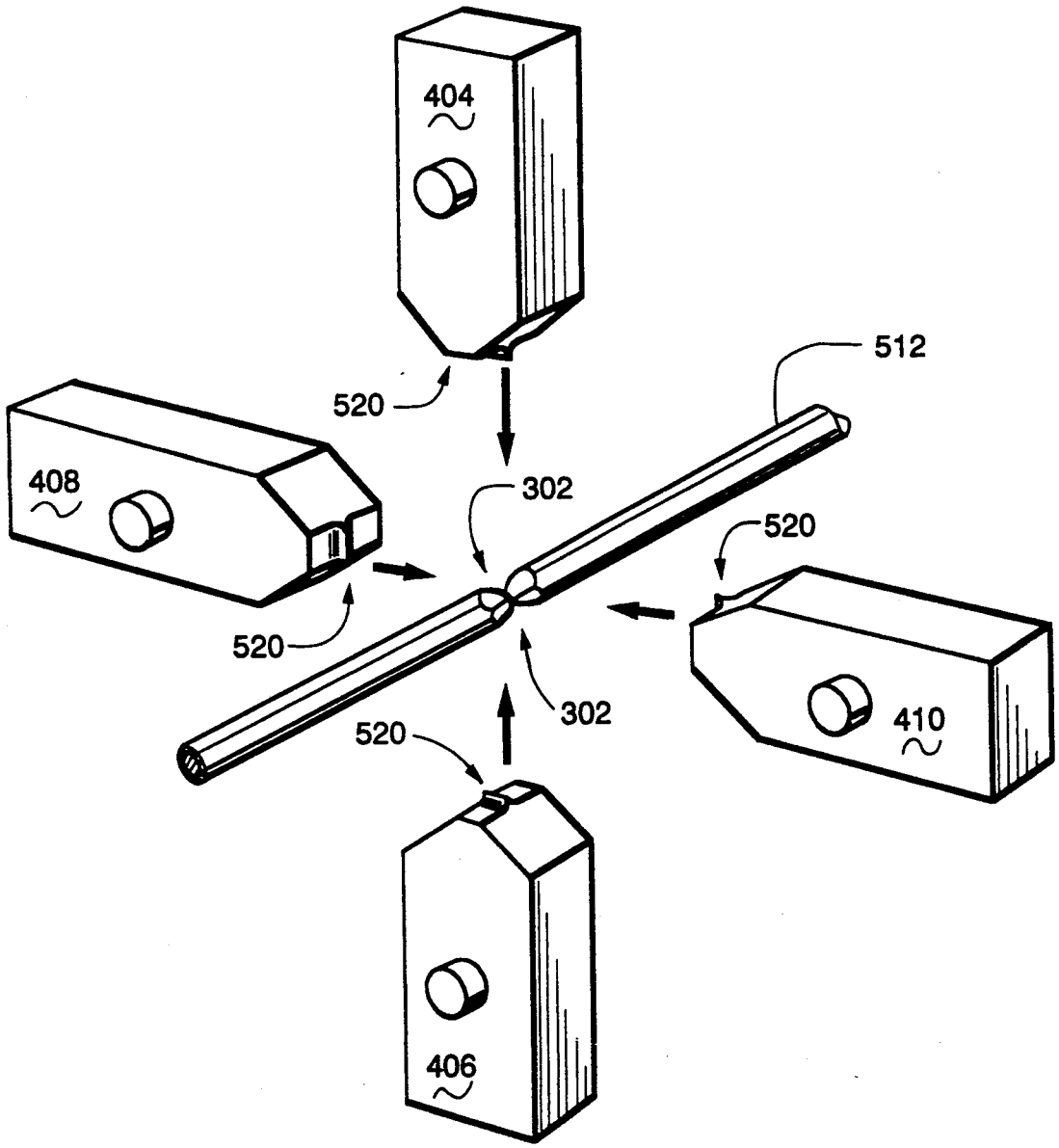
FIG. 18B is an enlarged perspective view of working ends of forming tools for forming a pair of the pin tips illustrated in FIGS. 9–11 connected end to end in a preplated wire.

FIG. 18B is an enlarged perspective view of working ends 520 of forming tools 404,406,408,410 configured as molds for forming a pair of the pin tips 302 illustrated in FIGS. 9–11 connected end to end in a preplated wire 512. In order to make the pin tips 302 illustrated in FIGS. 9–11, the multi-swat apparatus 400 should be arranged in the first configuration illustrated in FIGS. 15A, 15B and 15C where alternating pairs of the four working ends 520 simultaneously swat the wire sides at a time.

Figure 18C:
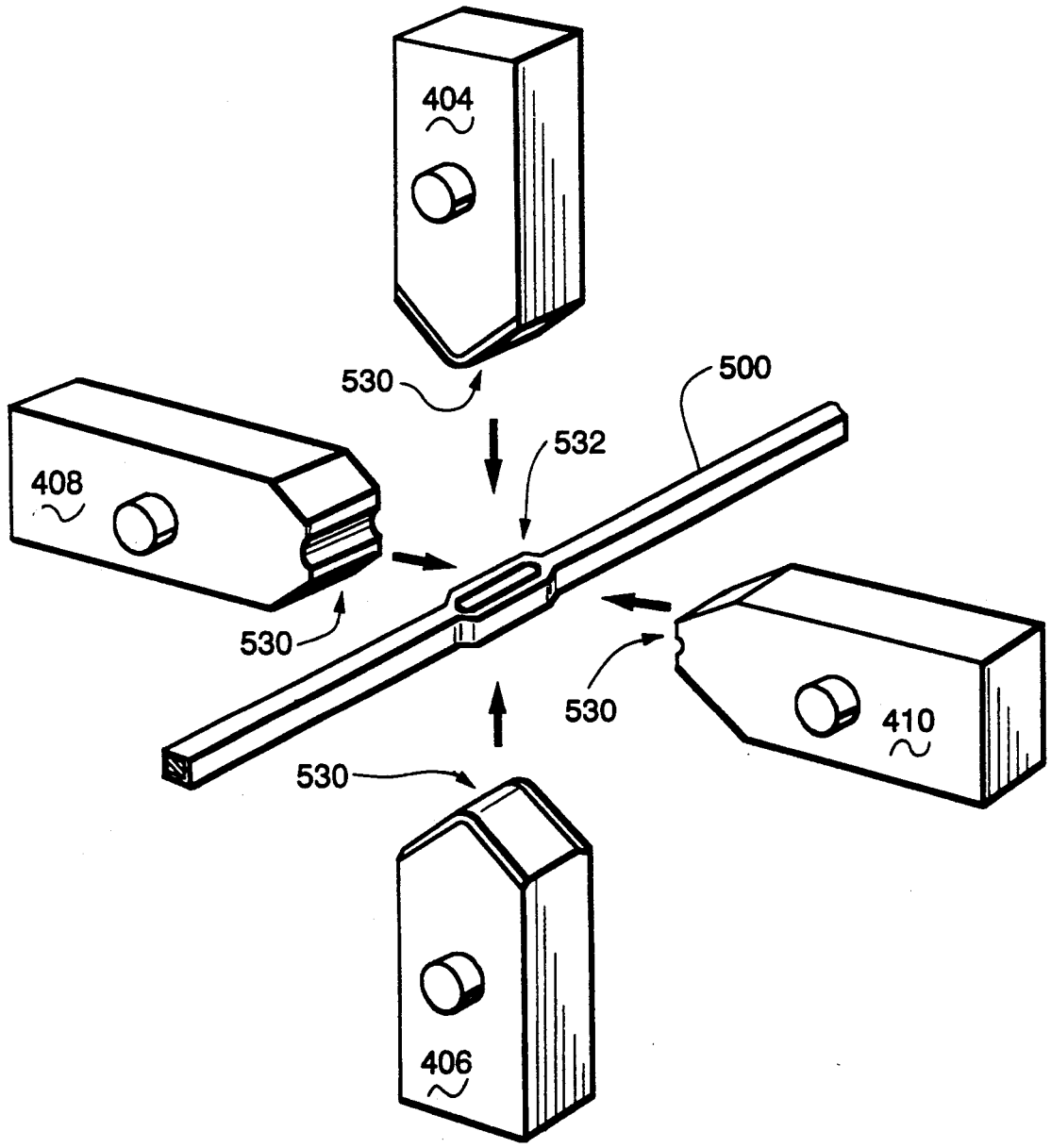
FIG. 18C is an enlarged perspective view of working ends of forming tools for forming a bowtie compliant section in a preplated wire.

FIG. 18C is an enlarged perspective view of working ends 530 of forming tools 404,406,408,410 configured as molds for forming a bowtie compliant section 532 in a preplated wire 500. The bowtie compliant or press fit 532 section is described in detail in U.S. Pat. No. 4,274,699 assigned to E. I. du Pont de Nemours and Company, with offices in Wilmington, De. In order to make the bowtie compliant section 532, the multi-swat apparatus 400 can be arranged in the first configuration illustrated in FIGS. 15A, 15B and 15C where alternating pairs of the four working ends 530 simultaneously swat the wire sides at a time or the second configuration illustrated in FIGS.. 17A, 17B and 17C where all four of the working ends 530 simultaneously swat the wire sides.

Figure 18D:
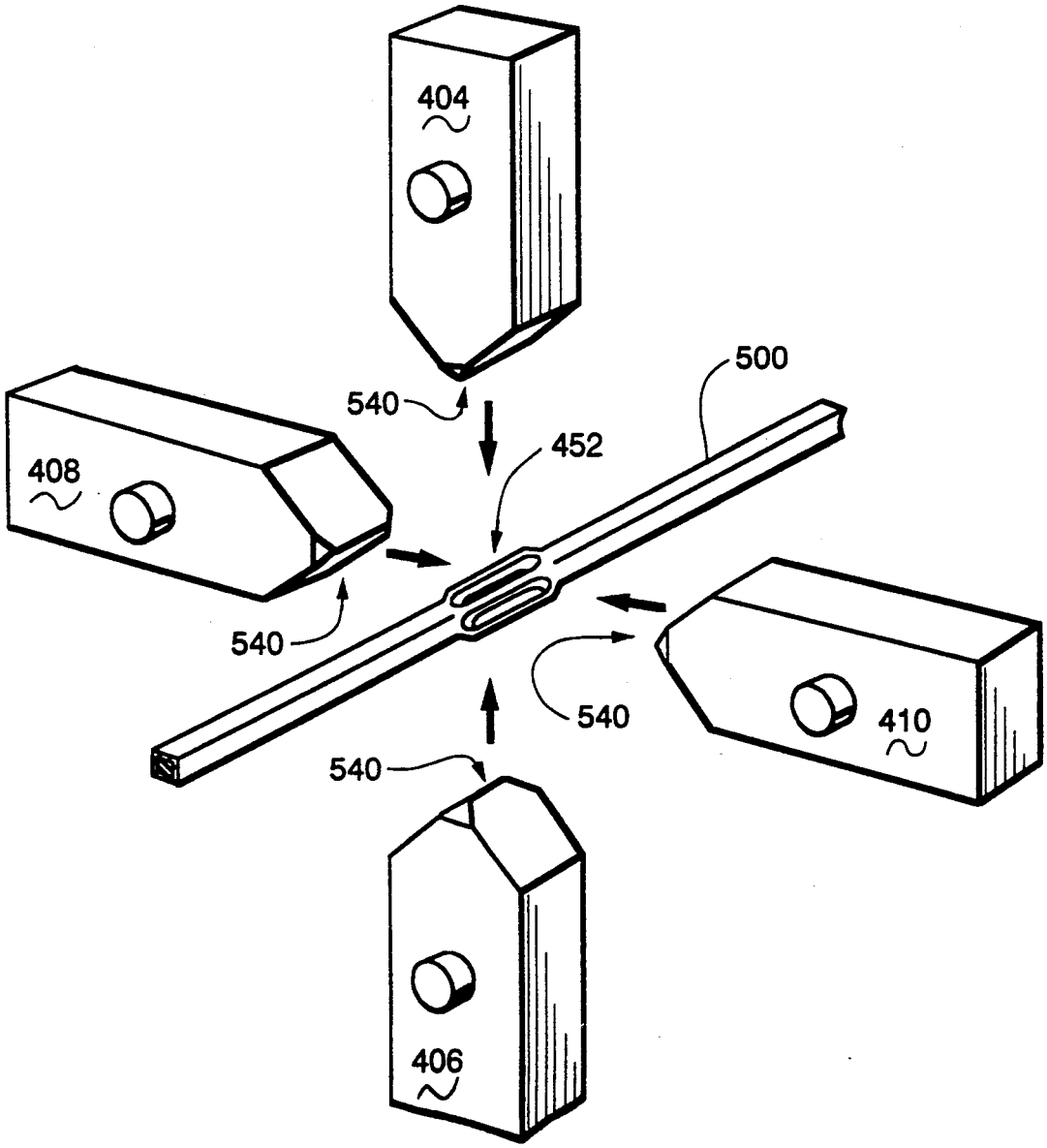
FIG. 18D is an enlarged perspective view of working ends of forming tools for forming a star retention section in a preplated wire.

FIG. 18D is an enlarged perspective view of working ends 540 of forming tools 404,406,408,410 configured as molds for forming a star retention section 452 in a preplated wire 500. The star section 452 is a relatively nondeformable retention section which is commercially available on terminals from E. I. du Pont de Nemours and Company. In order to make the star retention section 552, the multi-swat apparatus 400 should be arranged in the second configuration illustrated in FIGS. 17A, 17B and 17C where all four of the working ends 540 simultaneously swat the wire sides.

Those skilled in the art, having the benefit of the teachings of the present invention as hereinabove set forth, can effect numerous modifications thereto. These modifications are to be construed as being encompassed within the scope of the present invention as set forth in the appended claims.

What is claimed is:

1. A method for forming a feature on an elongated metal wire, comprising:

rotating a ring about a tool guide in a first direction, the ring connected by links to a first forming tool, a second forming tool, a third forming tool and a fourth forming tool causing the first forming tool and the second forming tool to slide in a first slot in the tool guide towards a first pair of distal sides of the wire;

simultaneously stamping the first pair of distal sides of the wire between a working end of the first forming tool and a working end of the second forming tool such that the working ends press into the first pair of the distal sides a first distance;

rotating the ring about the tool guide in a second direction moving the links to slide the third forming tool and the fourth forming tool in a second slot in the tool guide towards a second pair of distal sides of the wire and moving the links to slide the first forming tool and the second forming tool in the first slot away from the wire;

simultaneously stamping the second pair of distal sides of the wire between a working end of the third forming tool and a working end of the fourth forming tool such that the working ends press into the second pair of the distal sides a second distance;

rotating the ring about the tool guide in the first direction moving the links to slide the first forming tool and the second forming tool in the first slot towards the first pair of distal sides of the wire and moving the links to slide the third forming tool and the fourth forming tool in the second slot away from the wire;

simultaneously stamping the first pair of the distal sides of the wire between the working end of the first forming tool and a working end of the second forming tool such that the working ends press into the first pair of the distal sides a third distance;

rotating the ring about the tool guide in the second direction moving the links to slide the third forming tool and the fourth forming tool in the second slot in the tool guide towards the second pair of distal sides of the wire and moving the links to slide the first forming tool and the second forming tool in the first slot away from the wires; and simultaneously stamping the second pair of distal sides of the wire between the working end of the third forming tool and the working end of the fourth forming tool such that the working ends press into the second pair of the distal sides a fourth distance, whereby the feature is formed in the sides of the metal wire.

2. The method of claim 1, wherein the third and fourth distances are greater than the first and second distances.

3. The method of claim 1, wherein:

the second stamping step is performed after the first stamping step; and the fourth stamping step is performed after the third stamping step.

4. The method of claim 3, further comprising:

repeating the third and fourth stamping steps at least once to provide a smoother surface on the feature.

5. The method of claim 1, wherein:

the second stamping step is performed simultaneously with the first stamping step; and the fourth stamping step is performed simultaneously, with the third stamping step.

6. The method of claim 5, further comprising:

repeating the third and fourth stamping steps at least once to provide a smoother surface on the feature.

7. The method of claim 1, further comprising:

repeating the third and fourth stamping steps at least once to provide a smoother surface on the feature.

8. The method of claim 1, wherein the feature is a pair of electrical terminal pin tips connected end to end, each one of the pin tips comprising:

an electrically conductive layer; and an electrically conductive core with an axis of symmetry, the core having:

a non-plated substantially flat end having at least one edge, the non-plated substantially flat ends of the pin tips connected together; and at least one curved side substantially plated with the conductive layer, each one of the sides extending from a corresponding one of the flat end edges away from the axis of symmetry.

9. The method of claim 7, further comprising:

applying a force substantially perpendicular to the axis of symmetry near one of the pin tips with respect to the other one of the pin tips to shear the pin tips apart forming the non-plated substantially flat ends.

10. The method of claim 7, further comprising:

rotating one of the pin tips about the axis of symmetry with respect to the other one of the pin tips to break the pin tips apart forming the non-plated substantially flat ends.

11. The method of claim 7, wherein the wire is preplated with the layer and has a square cross section.

12. The method of claim 7, wherein the wire is preplated with the layer and has a circular cross section.

13. The method of claim 1, wherein the feature is a compliant section.

14. The method of claim 1, wherein the feature is a retention section.

* * * * *